US012193624B2

(12) United States Patent
Li et al.

(10) Patent No.: US 12,193,624 B2
(45) Date of Patent: Jan. 14, 2025

(54) AUTONOMOUS CLEANING DEVICE

(71) Applicant: Beijing Roborock Technology Co., Ltd., Beijing (CN)

(72) Inventors: Xing Li, Beijing (CN); Pan Cheng, Beijing (CN); Chuanlin Duan, Beijing (CN); Zhimin Yang, Beijing (CN); Jungang Liu, Beijing (CN); Fan Yang, Beijing (CN); Erdong Gu, Beijing (CN); Rongxin Hu, Beijing (CN); Lei Wang, Beijing (CN); Lei Zhang, Beijing (CN)

(73) Assignee: Beijing Roborock Technology Co., Ltd., Beijing (CN)

( * ) Notice: Subject to any disclaimer, the term of this patent is extended or adjusted under 35 U.S.C. 154(b) by 0 days.

(21) Appl. No.: 18/116,355

(22) Filed: Mar. 2, 2023

(65) Prior Publication Data

US 2023/0200617 A1 Jun. 29, 2023

Related U.S. Application Data

(63) Continuation of application No. 17/678,559, filed on Feb. 23, 2022, now Pat. No. 11,612,295, which is a (Continued)

(30) Foreign Application Priority Data

Jan. 4, 2021 (CN) ..... 202110004713.5
Feb. 1, 2021 (CN) ..... 202110138563.7
(Continued)

(51) Int. Cl.
*A47L 11/40* (2006.01)

(52) U.S. Cl.
CPC ..... *A47L 11/4058* (2013.01); *A47L 11/4069* (2013.01); *A47L 11/4097* (2013.01); *A47L 2201/00* (2013.01)

(58) Field of Classification Search
CPC ..... A47L 11/4066; A47L 5/22; A47L 9/009; A47L 9/2842; A47L 9/2852; A47L 11/4069
See application file for complete search history.

(56) References Cited

U.S. PATENT DOCUMENTS 4,754,520 A * 7/1988 Steadings ..... A47L 5/34 15/360
9,907,449 B2 3/2018 Lu et al.
(Continued)

FOREIGN PATENT DOCUMENTS

AU 2014221266 A1 9/2014
CN 202589457 U 12/2012
(Continued)

OTHER PUBLICATIONS

Office Action dated Dec. 28, 2022, issued in corresponding Taiwanese Patent Application No. 111114721.
(Continued)

*Primary Examiner* — Marc Carlson
(74) *Attorney, Agent, or Firm* — Morgan, Lewis & Bockius LLP

(57) ABSTRACT

An autonomous cleaning device, includes: a mobile platform, configured to move autonomously on a cleaning surface; and a cleaning module, disposed on the mobile platform and including a wet cleaning module, configured to clean at least part of the cleaning surface in a wet cleaning mode.

19 Claims, 21 Drawing Sheets

Related U.S. Application Data continuation of application No. 17/568,079, filed on Jan. 4, 2022, now abandoned.

(30) Foreign Application Priority Data

Feb. 10, 2021 (CN) ..... 202110184810.7
Feb. 10, 2021 (CN) ..... 202110188181.5

(56) References Cited

U.S. PATENT DOCUMENTS

| | | | | |
|---|---|---|---|---|
| 2006/0278161 | A1 | 12/2006 | Burkholder et al. | |
| 2009/0133204 | A1* | 5/2009 | Lin | A47L 11/24 180/2.1 |
| 2014/0182627 | A1 | 7/2014 | Williams et al. | |
| 2016/0150934 | A1* | 6/2016 | Kim | A47L 11/4036 15/300.1 |
| 2021/0034062 | A1* | 2/2021 | Ahn | A47L 11/4038 |
| 2021/0113038 | A1 | 4/2021 | Lee et al. | |
| 2022/0047141 | A1* | 2/2022 | Xu | A47L 11/4055 |
| 2022/0071467 | A1* | 3/2022 | Zhang | A47L 11/4011 |
| 2022/0079406 | A1* | 3/2022 | Zhang | A47L 11/4011 |
| 2022/0167821 | A1* | 6/2022 | Schnittman | A47L 11/4008 |
| 2022/0248930 | A1* | 8/2022 | Li | A47L 11/4069 |

FOREIGN PATENT DOCUMENTS

| | | | | | |
|---|---|---|---|---|---|
| CN | 106166050 | A | * | 11/2016 | |
| CN | 206166838 | U | * | 5/2017 | |
| CN | 107184156 | A | | 9/2017 | |
| CN | 108829115 | A | | 11/2018 | |
| CN | 109199205 | A | | 1/2019 | |
| CN | 109549573 | A | | 4/2019 | |
| CN | 109602352 | A | * | 4/2019 | A47L 11/293 |
| CN | 109730588 | A | * | 5/2019 | |
| CN | 208851397 | U | | 5/2019 | |
| CN | 109984688 | A | | 7/2019 | |
| CN | 110215166 | A | | 9/2019 | |
| CN | 110393477 | A | | 11/2019 | |
| CN | 110448241 | A | | 11/2019 | |
| CN | 110507253 | A | | 11/2019 | |
| CN | 110558900 | A | | 12/2019 | |
| CN | 110710932 | A | * | 1/2020 | A46B 13/001 |
| CN | 110934545 | A | | 3/2020 | |
| CN | 111208811 | A | | 5/2020 | |
| CN | 111345744 | A | | 6/2020 | |
| CN | 111345745 | A | | 6/2020 | |
| CN | 111427357 | A | | 7/2020 | |
| CN | 111481097 | A | | 8/2020 | |
| CN | 111588317 | A | * | 8/2020 | |
| CN | 211324758 | U | | 8/2020 | |
| CN | 211559965 | U | | 9/2020 | |
| CN | 111728536 | A | | 10/2020 | |
| CN | 211796249 | U | | 10/2020 | |
| CN | 111870196 | A | | 11/2020 | |
| CN | 111904346 | A | | 11/2020 | |
| CN | 112568810 | A | | 3/2021 | |
| CN | 112690713 | A | | 4/2021 | |
| CN | 112716373 | A | * | 4/2021 | A47L 11/24 |
| CN | 112790672 | A | | 5/2021 | |
| CN | 112806915 | A | | 5/2021 | |
| CN | 112806916 | A | | 5/2021 | |
| CN | 112806917 | A | | 5/2021 | |
| CN | 113693499 | A | | 11/2021 | |
| CN | 215687460 | U | * | 2/2022 | A47L 11/24 |
| JP | 2005533567 | A | | 11/2005 | |
| JP | 2007286730 | A | | 11/2007 | |
| JP | 2009095361 | A | | 5/2009 | |
| JP | 2015512684 | A | | 4/2015 | |
| JP | 2016000074 | A | | 1/2016 | |
| JP | 2018196622 | A | | 12/2018 | |
| JP | 2019084095 | A | | 6/2019 | |
| JP | 2019109845 | A | | 7/2019 | |
| KR | 10-2012-0088314 | A | | 8/2012 | |
| KR | 20120088314 | A | * | 8/2012 | |
| KR | 20140126433 | A | | 10/2014 | |
| RU | 2517013 | C1 | | 5/2014 | |
| RU | 2579137 | C1 | | 3/2016 | |
| RU | 2697154 | C1 | | 8/2019 | |
| TW | 201338747 | A | | 10/2013 | |
| TW | 202112292 | A | | 4/2021 | |
| TW | M633591 | U | | 11/2022 | |
| WO | 2016/036183 | A1 | | 3/2016 | |
| WO | 2019/233493 | A1 | | 12/2019 | |
| WO | 2021/008611 | A1 | | 1/2021 | |
| WO | 2021136023 | A1 | | 7/2021 | |
| WO | 2021228208 | A1 | | 11/2021 | |
| WO | 2022116584 | A1 | | 6/2022 | |

OTHER PUBLICATIONS

Office Action dated Jan. 10, 2023, issued in corresponding Chinese Patent Application No. 202110188181.5.

Office Action issued in the corresponding JP Application No. 2023-543382, dated Jun. 25, 2024.

Office Action issued in the corresponding TW Application No. 112149355, dated May 31, 2024.

Office Action issued in the corresponding AU Application No. 2021411295, dated Sep. 16, 2024.

Office Action issued in the corresponding RU Application No. 2024114502, dated Oct. 10, 2024.

Decision of Refusal issued in the corresponding JP Application No. 2023-540845, mailed Nov. 19, 2024.

* cited by examiner

AUTONOMOUS CLEANING DEVICE

CROSS REFERENCE TO RELATED APPLICATION(S)

The present application is a Continuation Application of US patent application Ser. No. 17/678,559 which claims the priority of Chinese patent application No. 202110004713.5 filed on Jan. 4, 2021, Chinese patent application No. 202110138563.7 filed on Feb. 1, 2021, Chinese patent application No. 202110188181.5 filed on Feb. 10, 2021, and Chinese patent application No. 202110184810.7 both filed on Feb. 10, 2021, the entire disclosures of all these Chinese patent applications being incorporated herein as part of the present disclosure for all purposes.

TECHNICAL FIELD

The present disclosure relates to an autonomous cleaning device.

BACKGROUND

Cleaning robots mainly include sweeping robots and mopping robots. Functions of the sweeping robots and the mopping robots are relatively simple. The sweeping robots can only sweep a floor, while the mopping robots can only mop a floor. If it is desirable to perform sweeping and mopping at the same time, two devices are required, which doubles the occupied space.

If a sweeping robot and a mopping robot are combined, a mop is added to an end of the sweeping robot to achieve the integrated sweeping and mopping, and the mopping function is achieved in the integrated cleaning process only by moving the mop on the floor. A single mopping operation is being performed in a moving trajectory of the cleaning robot with movement of the mop, which may greatly reduce the mopping effect and efficiency. This is especially true for some environments where more stains exist on a floor. Obviously, the floor cannot be cleaned by moving the mop only once. In addition, there are other problems with the autonomous cleaning device. For example, heights of cleaning components of the cleaning device cannot be adjusted, and are tightly attached to a surface to be cleaned all the time. Thus, it is difficult for the cleaning device to move freely on the surface to be cleaned or to move with large resistance when it is not performing cleaning operation.

SUMMARY

At least one embodiment of the present disclosure provides an autonomous cleaning device, including:

a mobile platform, configured to move autonomously on a cleaning surface; and a cleaning module disposed on the mobile platform, the cleaning module including:

a wet cleaning module, configured to clean at least part of the cleaning surface in a wet cleaning mode; and a lifting structure, connected to the wet cleaning module and configured to enable the wet cleaning module to move upwards or downwards with respect to the mobile platform;

wherein the wet cleaning module includes: a cleaning head configured to clean the cleaning surface, and a driving unit configured to drive the cleaning head to conduct a reciprocating movement on a target surface, which indicates a part of the cleaning surface.

At least one embodiment of the present disclosure further provides an autonomous cleaning device, including: a mobile platform configured to move autonomously on a cleaning surface; and a cleaning module disposed on the mobile platform. The cleaning module includes: a dry cleaning module, configured to clean at least part of the cleaning surface in a dry cleaning mode; and a wet cleaning module, configured to clean at least part of the cleaning surface in a wet cleaning mode. The wet cleaning module includes: a cleaning head, configured to clean the cleaning surface; and a driving unit, configured to drive the cleaning head to conduct reciprocating movement along a target surface, wherein the target surface is a part of the cleaning surface.

At least one embodiment of the present disclosure further provides a method of a cleaning robot escaping from a trapped state, a device for a cleaning robot escaping from a trapped state, a computer-readable storage medium, and an electronic apparatus.

At least one embodiment of the present disclosure provides a method of a cleaning robot escaping from a trapped state, which is applicable to a cleaning robot including a surface media sensor. The method includes: determining that a second surface media area is detected in response to a change in a surface media signal from the surface media sensor in a case that the cleaning robot encounters an obstacle and changes its travelling direction when the cleaning robot performs cleaning operation along an edge of a first surface media area; searching for the second surface media area in an established room map to determine whether the second surface media area exists in the room map; in a case that the second surface media area exists in the room map, determining whether there is a path bypassing the second surface media area according to the room map and a boundary of the second surface media area in the room map; in a case that the path exists, controlling the cleaning robot to travel along the path to avoid the second surface media area; and in a case that the path does not exist, controlling the cleaning robot to return along a cleaned path to avoid the second surface media area.

At least one embodiment of the present disclosure further provides a computer-readable storage medium on which a computer program is stored, wherein in a case that the computer program is executed by a processor, operations of the method of the cleaning robot escaping from the trapped state as described above are implemented.

At least one embodiment of the present disclosure further provides an electronic apparatus, including: a processor; and a memory, configured to store executable instructions executable by the processor, wherein in a case that executable instructions are executed, the processor is configured to perform operations of the method of the cleaning robot escaping from the trapped state as described above.

BRIEF DESCRIPTION OF THE DRAWINGS

The drawings herein are incorporated in and constitute a part of the present specification, illustrate embodiments consistent with the present disclosure, and serve to explain the principle of the present disclosure together with the description. Obviously, the drawings in the following description are merely some embodiments of the present disclosure. For those of ordinary skill in the art, other drawings may be obtained based on these drawings without creative efforts.

Figure 1:
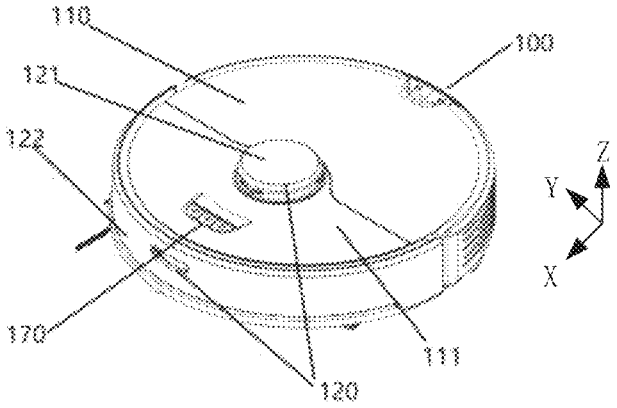
FIG. 1 illustrates an oblique view of an autonomous cleaning device according to an embodiment of the present disclosure.

DESCRIPTION OF REFERENCE NUMBERS mobile platform 100, rear part 110, front part 111, sensing system 120, location determination device 121, buffer 122, cliff sensor 123, control system 130, driving system 140, driving wheel assembly 141, steering assembly 142, elastic element 143, driving motor 146, cleaning module 150, dry cleaning module 151, dust box 152, filter 153, dust suction port 154, air outlet 155, fan 156, side brush 157, power system 160, human-computer interaction system 170, wet cleaning module 400, cleaning head 410, driving unit 420, driving platform 421, support platform 422, motor 4211, driving wheel 4212, vibration member 4213, connection rod 4214, vibration buffer device 4215, claw 4216, pump tube 4218, pump 4219, cleaning base plate 4221, elastic detachment button 4229, fitting section 4224, buckle position 4225, first sliding groove 4222, second sliding groove 4223, first slider 525, second slider 528, swinging end 512 (4227), sliding end 514 (4226), first pivot 516 (624), second pivot 518 (626), driving mechanism 800 (600, 700), four-linkage lifting structure 500, first connection end 501, second connection end 502, first holder 5011, first pair of connection rods 5012, first connection rod 50121, second connection rod 50122, cable 5013, first terminal of cable 50131, second terminal of cable 50132, transverse beam 50111, sliding groove 50112, buckle hole 50113, first longitudinal beam 50114, second longitudinal beam 50115, second holder 5021, second pair of connection rods 5022, third connection rod 50221, fourth connection rod 50222, surface media sensor 103, carpet 301, wall 302, narrow gap 303, first carpet 401, second carpet 402, device for cleaning robot escaping from trapped state 2900, surface media determination module 2901, first control module 2902, second control module 2903, electronic apparatus 3000, processing unit 3010, storage unit 3020, bus 3030, display unit 3040, random access storage unit (RAM) 30201, cache storage unit 30202, read-only storage unit (ROM) 30203, program or utility tool 30204, program modules 30205, input/output (I/O) interface 3050, network adapter 3060, peripheral devices 3070.

DETAILED DESCRIPTION

In order to make objectives, technical solutions and advantages of the present disclosure clearer, the present disclosure will be further described in detail below with reference to the accompanying drawings. Obviously, the described embodiments are only a part of embodiments of the present disclosure, rather than all the embodiments of the present disclosure. Based on the described embodiments in the present disclosure, all other embodiments obtained by those ordinary skilled in the art without creative efforts shall fall within the protection scope of the present disclosure.

The terms used in embodiments of the present disclosure are only for the purpose of describing specific embodiments, and are not intended to limit the present disclosure. Singular forms of "a", "said" and "the" used in embodiments of the present disclosure and the appended claims are also intended to include plural forms, unless the context clearly indicates other meanings. "Multiple" or "a plurality of" generally means at least two.

It should be understood that the term "and/or" used herein is only indicative of an association relationship among the associated objects, and represents that there may be three relationships. For example, A and/or B may represent that: A exists alone, A and B exist simultaneously, and B exists alone. In addition, the character "/" herein generally indicates that the associated objects listed before and after the character are in an "or" relationship.

It should be understood that although the terms first, second, third, etc. may be used refer to several components in embodiments of the present disclosure, these components should not be limited to these terms. These terms are only intended to distinguish these components. For example, without departing from the scope of embodiments of the present disclosure, the first component can also be referred to as the second component, and similarly, the second component can also be referred to as the first component.

Depending on the context, the word "if" as used herein can be interpreted as "when" or "upon" or "in response to". Similarly, depending on the context, the phrase "if it is determined" or "if it is detected" may be interpreted as "when it is determined", "in response to determination", "upon determination", or "in response to detection", and the phrase "if it is detected" may be interpreted as "when it is detected", "upon detection", or "in response to detection".

It should also be noted that the terms "including", "comprising" or any other variation thereof are intended to cover non-exclusive inclusion, so that a product or a device that includes a series of elements not only includes those elements, but also includes those that are not explicitly listed or elements inherent to such product or device. Without more restriction, an element defined by the sentence "including a/an . . . " does not exclude the existence of other identical elements in the product or device that includes such element.

Figure 2:
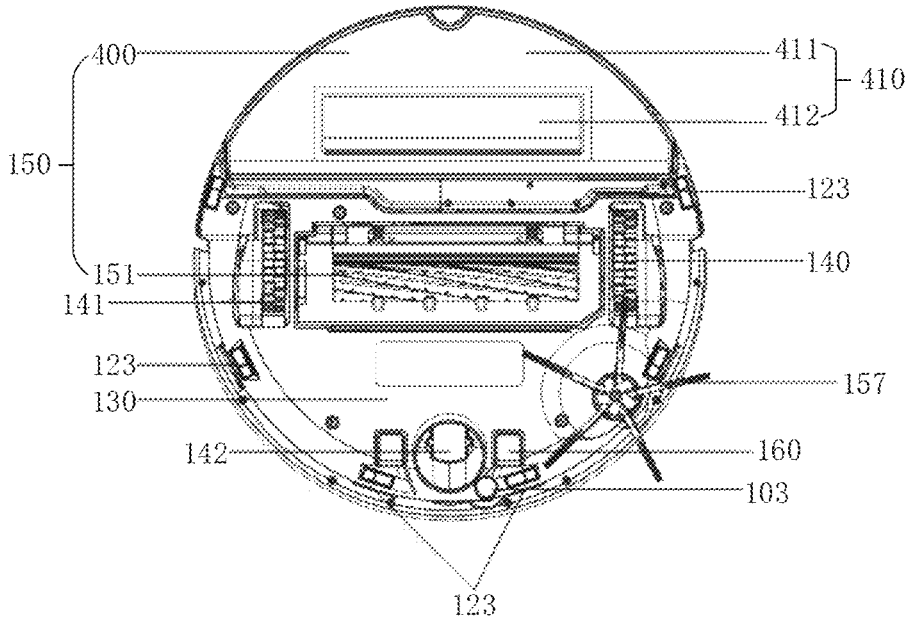
FIG. 2 illustrates a schematic structural view of a bottom part of an autonomous cleaning device according to an embodiment of the present disclosure.

FIGS. 1 to 2 illustrate schematic structural view of an autonomous cleaning device according to an embodiment of the present disclosure. As illustrated in FIGS. 1 to 2, the autonomous cleaning device may be a vacuum suction robot, a mopping/brushing robot, or a window cleaning robot, etc. The autonomous cleaning device may include a mobile platform 100, a sensing system 120, a control system 130, a driving system 140, a cleaning module 150, a power system 160, and a human-computer interaction system 170.

The mobile platform 100 may be configured to autonomously move in a target direction on a cleaning surface. The cleaning surface may be a surface to be cleaned by the autonomous cleaning device. In some embodiments of the present disclosure, the autonomous cleaning device may be a mopping robot, and the autonomous cleaning device operates on a floor, i.e., the floor being the cleaning surface. The autonomous cleaning device may further be a window cleaning robot, where the autonomous cleaning device operates on a outer glass surface of a building, and the glass is the cleaning surface. The autonomous cleaning device may further be a pipe cleaning robot, where the autonomous cleaning device operates on an inner surface of the pipe, and the inner surface of the pipe is the cleaning surface. Merely for the purpose of demonstration, the following description in the present disclosure takes the mopping robot as an example.

In some embodiments of the present disclosure, the mobile platform 100 may be an autonomous mobile platform or a non-autonomous mobile platform. The autonomous mobile platform means that the mobile platform 100 may make operational decisions autonomously and adaptively on its own based on unexpected environment inputs. The non-autonomous mobile platform cannot make the operational decisions adaptively on its own based on the unexpected environment inputs, but may execute established procedures or operate in accordance with certain logic. Accordingly, when the mobile platform 100 is a autonomous mobile platform, the target direction may be determined autonomously by the autonomous cleaning device. When the mobile platform 100 is a non-autonomous mobile platform, the target direction may be set by a system or manually. When the mobile platform 100 is an autonomous mobile platform, the mobile platform 100 includes a front part 111 and a rear part 110.

The sensing system 120 includes sensing devices, such as a location determination device 121 located on the mobile platform 100, a buffer 122 located at the front part 111 of the mobile platform 100, a cliff sensor 123 and an ultrasonic sensor (not illustrated in the figures) located at a bottom part of the mobile platform, an infrared sensor (not illustrated in the figures), a magnetometer (not illustrated in the figures), an accelerometer (not illustrated in the figures), a gyroscope (not illustrated in the figures), an odometer (not illustrated in the figures) and the like, and provides various location information and motion state information of the robot to the control system 130.

In order to describe the operation of the autonomous cleaning device more clearly, directions are defined as follows. The autonomous cleaning device may travel on the floor through various combinations of movement relative to the following three mutually perpendicular axes as defined by the mobile platform 100: a transverse axis x, a front-rear axis y, and a center vertical axis z. A forward driving direction along the front-rear axis y is denoted as being "forward", and a rearward driving direction along the front-rear axis y is denoted as being "rearward". The transverse axis x essentially extends between a right wheel and a left wheel of the autonomous cleaning device along an axis passing through a center point of the driving wheel assembly 141. The autonomous cleaning device can rotate around the x-axis. When the front part of the autonomous cleaning device is inclined upward and the rear part is inclined downward, it is referred as being "pitching upward". When the front part of the autonomous cleaning device is inclined downward, and the rear part is inclined upward, it is referred as being "pitching downward". In addition, the autonomous cleaning device may rotate around the z-axis. Along the forward direction of the autonomous cleaning device, when the autonomous cleaning device is inclined toward right side of the y-axis, it is referred as being "turning right", and when the autonomous cleaning device is inclined toward left side of the y-axis, it is referred as being "turning left".

As illustrated in FIG. 2, the cliff sensors 123 are disposed at the bottom part of the mobile platform 100 and also in front of and behind a driving wheel assembly 141. The cliff sensors 123 are configured to prevent the autonomous cleaning device from falling when it moves backwards, thereby avoiding damages to the autonomous cleaning device. The aforementioned wording "front" refers to a side in a direction same as a travelling direction of the autonomous cleaning device, and the aforementioned wording "behind" refers to a side in a direction opposite to the travelling direction of the autonomous cleaning device.

The location determination device 121 includes, but is not limited to, a camera and a laser distance sensor (LDS).

Various components of the sensing system 120 may operate independently or cooperate with each other to achieve an intended function more accurately. The cliff sensor 123 and the ultrasonic sensor identify the surface to be cleaned, so as to determine physical properties of the surface to be cleaned, including a surface media, degree of cleanliness, etc. Further, a more accurate determination may be made in combination with a camera, the laser distance sensor, and etc.

For example, the ultrasonic sensor may determine whether the surface to be cleaned is a carpet. If the ultrasonic sensor determines that the surface to be cleaned is a material of carpet, the control system 130 controls the autonomous cleaning device to perform cleaning in a carpet cleaning mode.

The front part 111 of the mobile platform 100 is provided with a buffer 122. When the driving wheel assembly 141 drives the autonomous cleaning device to travel on the floor during a cleaning process, the buffer 122 detects one or more events (or objects) along a travelling path of the autonomous cleaning device by a sensor system, such as an infrared sensor. The autonomous cleaning device may control the driving wheel assembly 141, based on the events (or objects) detected by the buffer 122, such as obstacles and walls, such that the autonomous cleaning device responds to the events (or objects), such as moving away from the obstacles.

The control system 130 is disposed on a main circuit board in the mobile platform 100, and includes a computing processor, such as a central processing unit, an application processor, in communication with a non-transitory memory, such as a hard disk, a flash memory, a random access memory. The application processor is configured to: receive environment information perceived by the multiple sensors and transmitted by the sensing system 120; create a simultaneous map of the environment where the autonomous cleaning device is located through a locating algorithm such as simultaneous localization and mapping (SLAM), according to obstacle information fed back by the laser distance sensor; autonomously determine a travelling path according to the environment information and the environment map; and then control the driving system 140 to perform operations such as moving forward, moving backward, and/or steering according to the autonomously determined travelling path. Further, the control system 130 may further determine whether to start the cleaning module 150 to perform a cleaning operation according to the environment information and the environment map.

In an embodiment of the present disclosure, in combination with distance information and speed information fed back by the sensing device such as the buffer 122, the cliff sensor 123, the ultrasonic sensor, the infrared sensor, the magnetometer, the accelerometer, the gyroscopes, and the odometer, the control system 130 may determine comprehensively which operation state the autonomous cleaning device is currently in, such as crossing a threshold, moving onto a carpet, being on a cliff, getting stuck at the top or bottom part, a full dust box, being picked up, etc. And further, the control system provides detailed next action strategy for different situations, so that the operation of the autonomous cleaning device conforms to the owner's requirements and provides enhanced user experience. Furthermore, the control system may plan an efficient and reasonable cleaning path and cleaning mode based on the real-time map information created by SLAM, which greatly improves the cleaning efficiency of the autonomous cleaning device.

Figure 3:
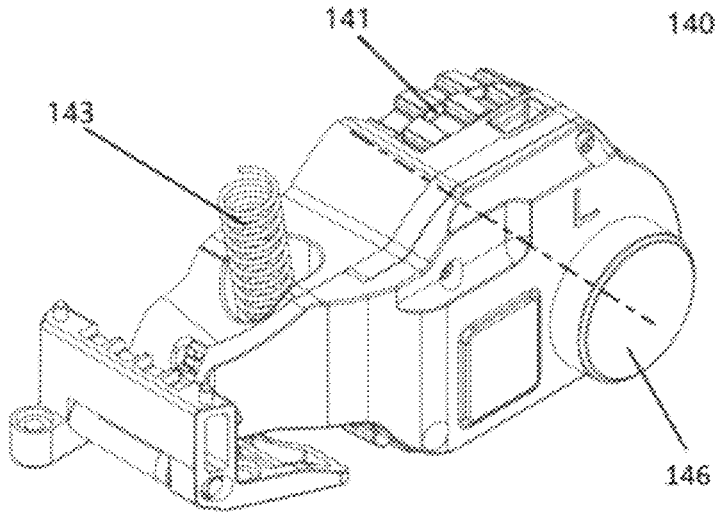
FIG. 3 illustrates an oblique view of a side driving wheel assembly according to an embodiment of the present disclosure.
Figure 4:
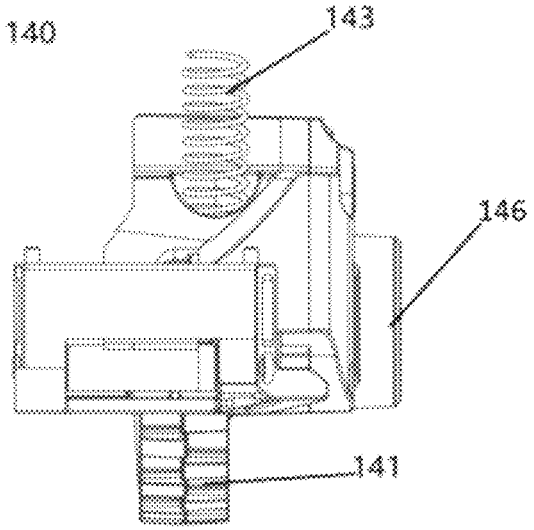
FIG. 4 illustrates a front view of a side driving wheel assembly according to an embodiment of the present disclosure.

The driving system 140 may execute a driving instructions based on distance and angle information (for example, x, y, and θ components), so as to manipulate the autonomous cleaning device to travel across the floor. FIGS. 3 and 4 illustrate respectively an oblique view and a front view of a side driving wheel assembly 141 according to an embodiment of the present disclosure. As illustrated in the figures, the driving system 140 includes the driving wheel assembly 141, and may control the left and right wheels at the same time. In order to more accurately control the motion of the robot, the driving system 140 may include a left driving wheel assembly and a right driving wheel assembly. The left and right driving wheel assemblies are symmetrically disposed along a transverse axis defined by the mobile platform 100. The driving wheel assembly includes a housing and a connection frame. The driving wheel assemblies are provided with a driving motor 146 respectively. The driving motor 146 is located outside the driving wheel assembly 141, and an axis of the driving motor 146 is located within a cross-sectional projection of the driving wheel assembly. The driving wheel assembly 141 may further be connected to a circuit configured to measure a driving current and the odometer.

The autonomous cleaning device may include one or more steering assembly 142, so as to make the autonomous cleaning device to move more stably on the floor or have stronger motion ability. The steering assembly may be a driven wheel or a driving wheel, and a structure of the steering assembly includes, but is not limited to, universal wheels. The steering assembly 142 may be located in front of the driving wheel assembly 141.

The driving motor 146 provides power for rotation of the driving wheel assembly 141 and/or the steering assembly 142.

The driving wheel assembly 141 may be detachably connected to the mobile platform 100, which is convenient for disassembly, assembly, and maintenance. The driving wheel may have a suspension system of biased drop type. The driving wheel is fastened in a movable mode, for example, attached in a rotatable mode, to the mobile platform 100 of the autonomous cleaning device, and maintains contact with the floor and traction due to a certain grounding force through an elastic element 143, such as a tension spring or a compression spring. In addition, the cleaning module 150 of the autonomous cleaning device further contacts the surface to be cleaned with a certain pressure.

The power system 160 includes a rechargeable battery, such as a nickel-metal hydride battery and a lithium battery. The rechargeable battery may be connected to a charging control circuit, a battery pack charging temperature detection circuit, and a battery undervoltage monitoring circuit. The charging control circuit, the battery pack charging temperature detection circuit, and the battery undervoltage monitoring circuit are then connected to the single-chip micro-controller circuit. The autonomous cleaning device is connected to a charging station through a charging electrode disposed at a side or below a device body for charging. If there is dust on an exposed charging electrode, a plastic body around the electrode may melt and deform due to an accumulation effect of electric charges during the charging process, which even causes the electrode itself to deform, and interrupts normal charging.

The human-computer interaction system 170 includes a button on a host panel for the user to select functions. The human-computer interaction system 170 may further include a display screen and/or an indicator light and/or a speaker. The display screen, the indicator light and the speaker provide the user with the current state of the robot or the function selection options. The human-computer interaction system 170 may further include programs for a mobile client. For a cleaning device of path-navigation type, the mobile client may provide the user with a map of the environment where the device is located, and the location of the robot, thus providing the user with rich and user-friendly functions.

The cleaning module 150 may include a dry cleaning module 151 and/or a wet cleaning module 400.

As illustrated in FIGS. 5-8, the dry cleaning module 151 may include a rolling brush, a dust box, a fan, and an air outlet. The rolling brush that has a certain interaction with the floor sweeps garbage on the floor and rolls it to the front of a dust suction port between the rolling brush and the dust box. Then, the garbage is sucked into the dust box by the suction gas generated by the fan and passing through the dust box. The dust removal capacity of the sweeper may be characterized by dust pickup efficiency (DPU) of garbage. The dust pickup efficiency DPU is affected by the structure and material of the rolling brush, and is further affected by the dust suction port, the dust container, the fan, the air outlet, and air utilization of the air duct formed by connection parts between these four components. Further, the dust pickup efficiency DPU is also affected by the type and power of the fan. This is a complicated system scheme problem. Compared with an ordinary plug-in vacuum cleaner, improvement of dust removal capacity is of greater significance to the autonomous cleaning device with limited power. The improvement of dust removal capacity reduces the power requirements directly and effectively. That is to say, an robot that can clean a floor of 80 square meters with a single charge previously may evolve into a single charge for cleaning a floor of 180 square meters or more. In addition, the service life of the battery with less recharges will also be greatly increased, so that replacement frequency of the battery by the user will also be decreased. The improvement of dust removal capability is obvious and direct user experience, and the user may directly draw a conclusion about whether the sweeping/mopping is clean. The dry cleaning module may further include a side brush 157 having a rotation shaft, wherein the rotation shaft is at a certain angle with respect to the floor, for moving scraps to sweeping area of a rolling brush of the cleaning module 150.

Figure 5:
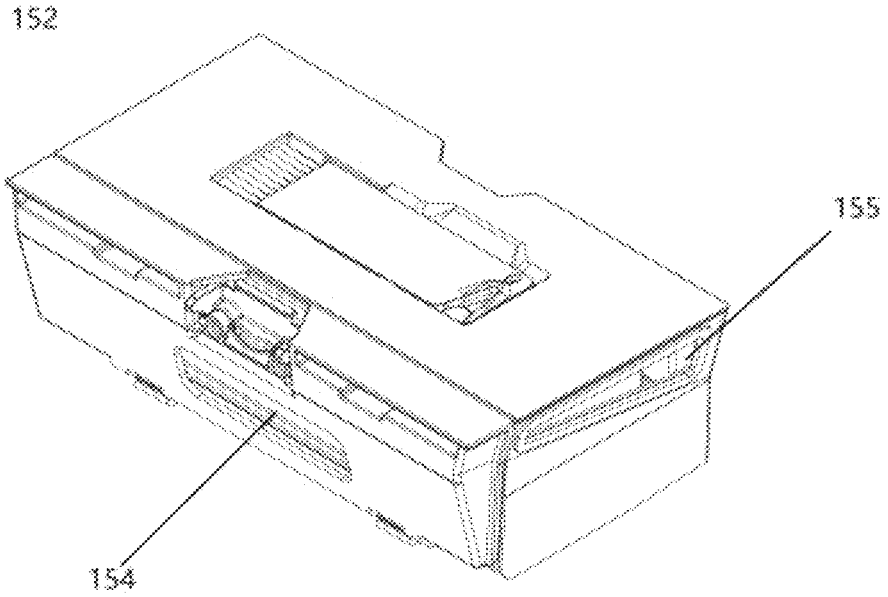
FIG. 5 illustrates an oblique view of a dust box according to an embodiment of the present disclosure.
Figure 6:
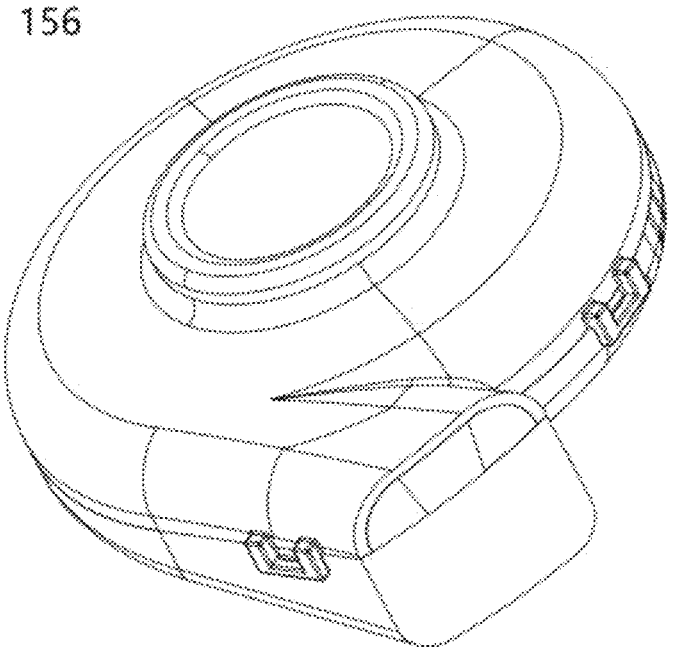
FIG. 6 illustrates an oblique view of a fan according to an embodiment of the present disclosure.
Figure 7:
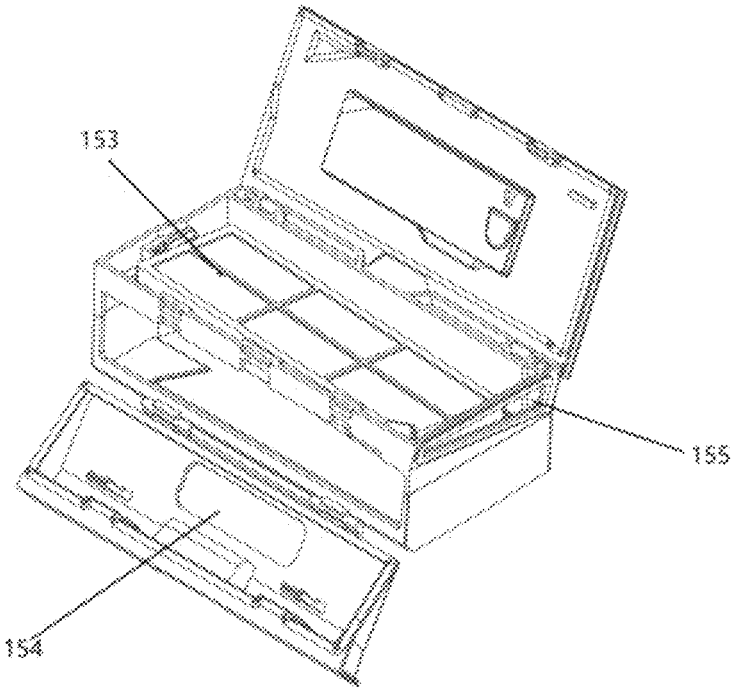
FIG. 7 illustrates a schematic view of a dust box in an opened state according to an embodiment of the present disclosure.
Figure 8:
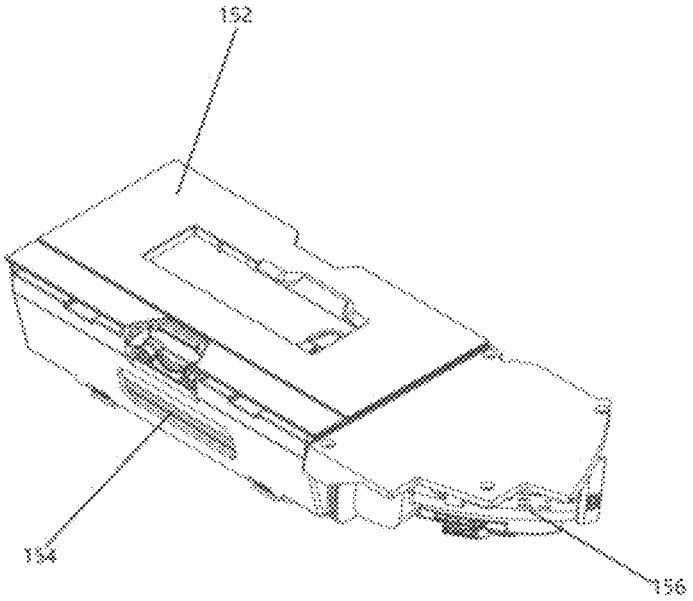
FIG. 8 illustrates a schematic view of a dust box and a fan in an assembled state according to an embodiment of the present disclosure.

FIG. 5 illustrates a schematic structural view of the dust box 152 of the dry cleaning module, FIG. 6 illustrates a schematic structural view of the fan 156 of the dry cleaning module, FIG. 7 illustrates a schematic view of the dust box 152 in an opened state, and FIG. 8 illustrates a schematic view of a dust box and a fan in an assembled state.

The roller brush, which has a certain interaction with the floor, sweeps the garbage on the floor and rolls it to the front of a dust suction port 154 between the roller brush and the dust box 152. The garbage is then sucked into the dust box 152 by the suction gas generated by the fan 156 and passing through the dust box 152. The garbage is separated by a filter 153 at a side inside the dust box 152 near the dust suction port 154. The filter 153 completely separates the dust suction port from an air outlet. The filtered air enters the fan 156 through the air outlet 155.

Typically, the dust suction port 154 of the dust box 152 is located in front of the robot, the air outlet 155 is located on a side of the dust box 152, and the suction port of the fan 156 abuts the air outlet of the dust box.

A front panel of the dust box 152 may be opened for cleaning the garbage in the dust box 152.

The filter 153 and a container body of the dust box 152 are detachably connected to facilitate detachment and cleaning of the filter.

Figure 9:
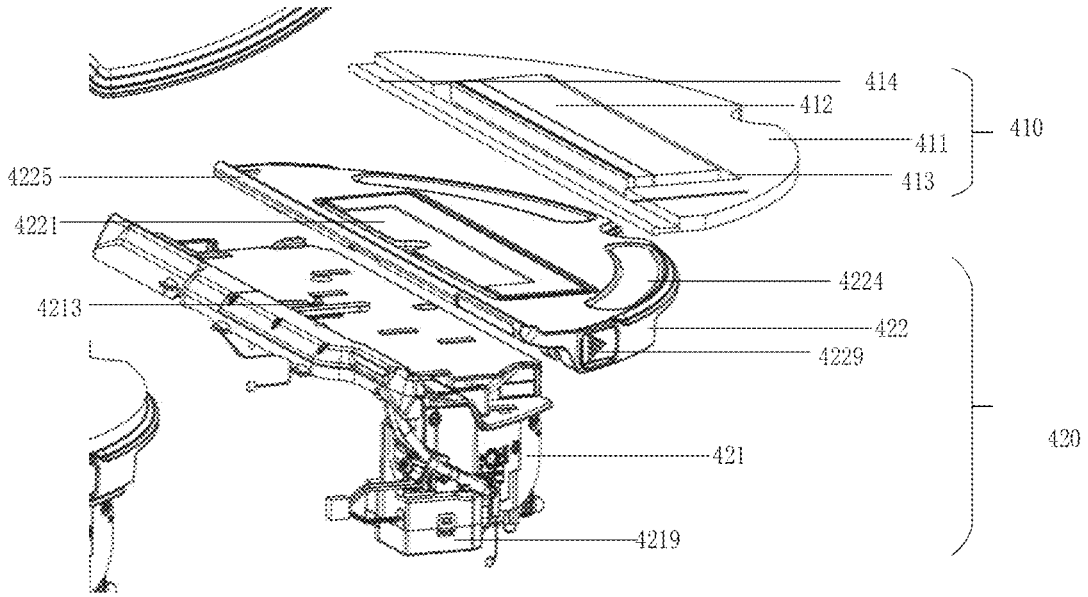
FIG. 9 illustrates an exploded view of an autonomous cleaning device according to an embodiment of the present disclosure.
Figure 10:
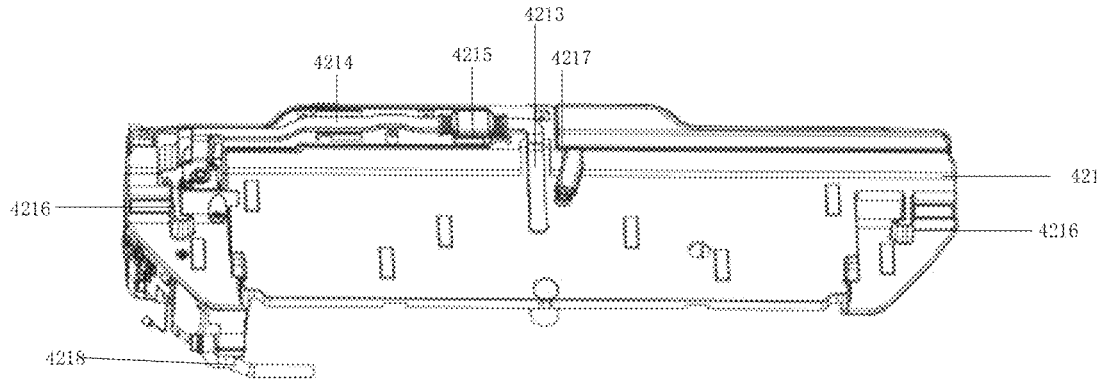
FIG. 10 illustrates a structural view of a support platform of an autonomous cleaning device according to an embodiment of the present disclosure.
Figure 11:
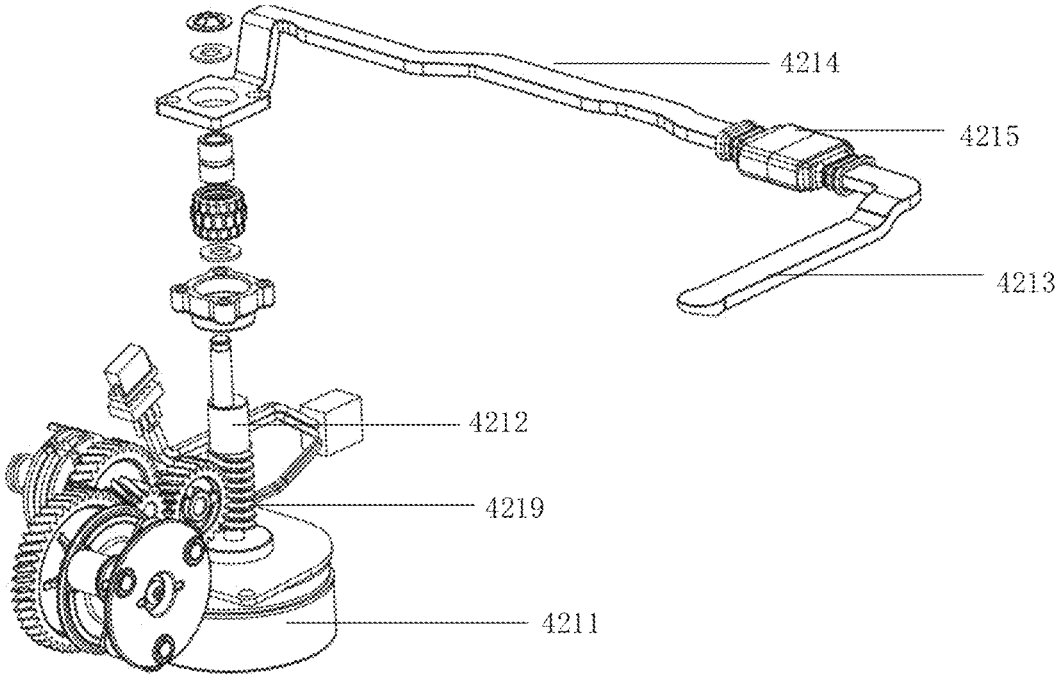
FIG. 11 illustrates a structural view of a vibration member of an autonomous cleaning device according to an embodiment of the present disclosure.

As illustrated in FIGS. 9-11, the wet cleaning module 400 in embodiments of the present disclosure is configured to clean at least part of the cleaning surface in a wet cleaning mode. The wet cleaning module 400 includes a cleaning head 410 and a driving unit 420. The cleaning head 410 is configured to clean at least part of the cleaning surface, and the driving unit 420 is configured to drive the cleaning head 410 to conduct a substantially reciprocating movement on a target surface. The target surface is part of the cleaning surface. The cleaning head 410 conducts reciprocating movement on the surface to be cleaned, and a contact surface of the cleaning head 410 in contact with the target surface is provided with a cleaning cloth or a cleaning base plate, which leads to high-frequency friction with respect to the target surface through the reciprocating movement, thereby removing stains from the target surface.

The higher the friction frequency, the more friction times per unit time. The high-frequency reciprocating movement, also called reciprocating vibration, has a greater cleaning capacity than the ordinary reciprocating movement, such as rotation. The friction cleaning, of which the friction frequency is optionally close to the sound wave, have a better cleaning effect than the rotating friction cleaning with dozens of turns per minute. On the other hand, hair tufts on the surface of the cleaning head may be more uniform and stretched in the same direction under the shaking of high-frequency vibration. In this case, the cleaning effect is not improved by increasing the friction force via the only downward pressure as applied under the low frequency rotation, wherein the only downward pressure would not cause the hair tufts to be stretched nearly in the same direction. Thus, the overall cleaning effect is more uniform. This is reflected in the effect that water marks on the cleaning surface after high-frequency vibration cleaning are more uniform, and no messy water mark is left.

The reciprocating movement may be repeated motions along any one or more directions within the cleaning surface. Alternatively, it may be vibrations perpendicular to the cleaning surface. The present disclosure is not strictly limited in this regard. Optionally, the directions of the reciprocating movements of the cleaning module is approximately perpendicular to the travelling direction of the autonomous cleaning robot, because the directions of the reciprocating movement parallel to the travelling direction of the autonomous cleaning robot would cause instability to the autonomous cleaning robot itself, due to the thrust and resistance in the travelling direction leading to the driving wheels prone to slip. The impact of slipping is more obvious when the wet cleaning module is included, because the wet cleaning surface increases the possibility of slipping. In addition to affecting the smooth moving and cleaning of the autonomous cleaning robot, the slipping may also cause the sensors such as the odometer, the gyroscope to be inaccurate in range measurement. This makes the autonomous cleaning device of navigation-type unable to accurately locate and create the map. In a case of frequent slipping, the impact on SLAM cannot be ignored. Therefore, it is necessary to avoid the robot from slipping as much as possible. In addition to slipping, the motion component of the cleaning head in the travelling direction of the autonomous cleaning robot causes the autonomous cleaning robot to be continuously pushed forwards or backwards when it is travelling. This makes the travelling of the robot unstable and unsmooth.

In an optional embodiment of the present disclosure, as illustrated in FIG. 9, the driving unit 420 includes: a driving platform 421, connected to a bottom surface of the mobile platform 100 and configured to provide a driving force; and a support platform 422, detachably connected to the driving platform 421 and configured to support the cleaning head 410, wherein the support platform 422 moves upwards or downwards under driving of the driving platform 421.

In an optional embodiment of the present disclosure, a lifting module is disposed between the cleaning module 150 and the mobile platform 100, such that the cleaning module 150 is in a good contact with the surface to be cleaned, or different cleaning modes are provided for the surface to be cleaned of different materials.

Optionally, the dry cleaning module 151 may be connected to the mobile platform 100 through a passive lifting module. When the cleaning device encounters an obstacle, the dry cleaning module 151 may cross over the obstacle through the lifting module more conveniently.

Optionally, the wet cleaning module 400 may be connected to the mobile platform 100 through an active lifting module. When the wet cleaning module 400 is out of operation temporarily, or when the wet cleaning module 400 cannot be clean the surface to be cleaned, the wet cleaning module 400 may be raised up by the active lifting module and separated from the surface to be cleaned, so as to change the cleaning mode.

As illustrated in FIGS. 10-11, the driving platform 421 includes: a motor 4211, disposed at a side of the driving platform 421 close to the mobile platform 100 and configured to output power through an output shaft of the motor; a driving wheel 4212, connected to the output shaft of the motor and having an asymmetrical structure; and a vibration member 4213, disposed at a side of the driving platform 421 opposite to the motor 4211 and connected to the driving wheel 4212, so that reciprocating movement of the vibration member 4213 may be achieved under the asymmetrical rotation of the driving wheel 4212.

The driving platform 421 may further include a driving wheel and a gear mechanism. The gear mechanism may connect the motor 4211 and the driving wheel 4212. The motor 4211 may directly drive the driving wheel 4212 to perform a swing motion, or indirectly drive the driving wheel 4212 to perform the swing motion through the gear mechanism. Those ordinary skilled in the art can understand that the gear mechanism may be a gear or a gear set comprising multiple gears.

The motor 4211 simultaneously transmits power to the cleaning head 410, the driving platform 421, the support platform 422, a liquid delivery mechanism, a liquid container, and etc. through a power transmission device. The power system 160 provides power for the motor 4211, and is controlled by the control system 130 as a whole. The power transmission device may be a gear drive, a chain drive, a belt drive, or a worm gear and so on.

The motor 4211 includes a forward output mode and a reverse output mode. The motor 4211 rotates forward in the forward output mode, and the motor 4211 rotates in a reverse direction in the reverse output mode. In the forward output mode of the motor 4211, the motor 4211 may drive, through the power transmission device, a vibration member 4213 of the driving platform in the wet cleaning module 400 to conduct a substantively reciprocating movement, and the liquid delivery mechanism simultaneously. In the reverse output mode of the motor 4211, the motor 4211 drives the driving platform 421 to rise up and lower down through the power transmission device.

Further, the driving platform 421 further includes a connection rod 4214, which extends along an edge of the driving platform 421, and connects the driving wheel 4212 with the vibration member 4213, so that the vibration member 4213 extends to a preset position. An extension direction of the vibration member 4213 is perpendicular to the connection rod 4214, so that a reciprocating direction of the vibration member 4213 is substantially perpendicular to a travelling direction of the autonomous cleaning robot.

Figure 15:
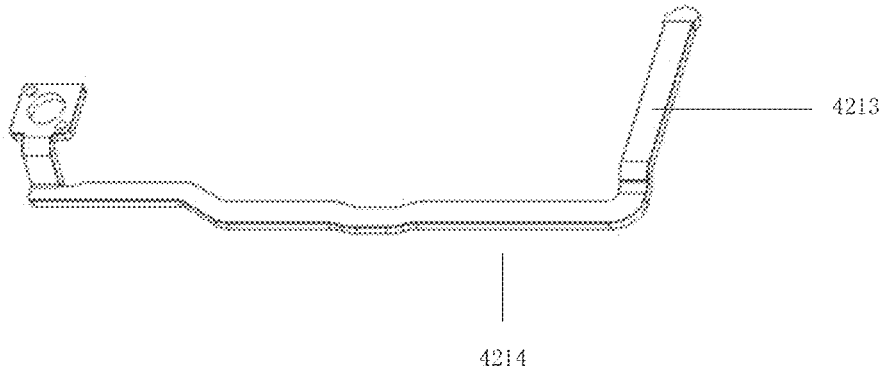
FIG. 15 illustrates a structural view of a vibration member according to an embodiment of the present disclosure.

The motor 4211 is connected to, through the power transmission device, the driving wheel 4212, the vibration member 4213, the connection rod 4214, and a vibration buffer device 4215. The vibration member 4213 and the connection rod 4214 constitute an approximate L-shaped structure. As illustrated in FIG. 15, the vibration member 4213 is driven by the connection rod 4214 to conduct the reciprocating movement. The vibration buffer device 4215 has an effect of damping and reducing jitter on the motion driven by the driving wheel 4212, so that the vibration member 4213 vibrates smoothly within the movement range that the support platform 422 can provide. Optionally, the vibration buffer device 4215 is made of a soft material, optionally a rubber structure, and the vibration buffer device 4215 is sleeved on the connection rod 4214. On the other hand, the vibration buffer device 4215 may further protect the vibration member 4213 from damage due to collision with the driving platform 421, thereby further affecting the reciprocating movement of the vibration member 4213. A less elastic connection between a movable part and a fixed part of the driving platform 421 restricts movement in the travelling direction of the autonomous cleaning robot, while a flexible connection in a direction substantially perpendicular to the travelling direction, that is, in the vibration direction of the vibration member 4213, allows movement. The two movement restrictions as mentioned above cause the movement of the vibration member 4213 to be not exactly reciprocating, but substantively reciprocating. When the wet cleaning module 400 is activated, the motor 4211 starts to rotate forward, and drives, through the driving wheel 4212, the connection rod 4214 to conduct reciprocating movement along a surface of the driving platform 421. At the same time, the vibration buffer device 4215 drives the vibration member 4213 to substantially conduct reciprocating movement along the surface of the driving platform 421. The vibration member 4213 drives the cleaning base plate 4221 to substantially conduct reciprocating movement along the surface of the driving platform 421. The cleaning base plate 4221 drives a movable section 412 to substantially conduct reciprocating movement along the surface to be cleaned. At this time, a pump causes clean water to flow out of a liquid container, and the clean water is sprayed on the cleaning head 410 through a liquid outlet device 4217. The cleaning head 410 cleans the surface to be cleaned through the reciprocating movement.

Cleaning strength or efficiency of the autonomous cleaning device may also be adjusted automatically and dynamically according to operation environment of the autonomous cleaning device. For example, the autonomous cleaning device may realize the dynamic adjustment through detecting physical information of the surface to be cleaned by the sensing system 120. For example, the sensing system 120 may detect flatness of the surface to be cleaned, a material of the surface to be cleaned, whether there is oil and dust, and so on, and transmit such information to the control system 130 of the autonomous cleaning device. Accordingly, the control system 130 may control the autonomous cleaning device to automatically and dynamically adjust a rotation speed of the motor and a transmission ratio of the power transmission device according to the operation environment of the autonomous cleaning device, thereby adjusting a preset reciprocating cycle of the reciprocating movement of the cleaning head 410.

For example, when the autonomous cleaning device is in operation on a flat floor, the preset reciprocating cycle may be automatically and dynamically adjusted to be longer, and a liquid volume of the pump may be automatically and dynamically adjusted to be smaller. When the autonomous cleaning device is in operation on a less flat floor, the preset reciprocating cycle may be automatically and dynamically adjusted to be shorter, and the liquid volume of the pump may be automatically and dynamically adjusted to be greater. This is because the flat floor is easier to clean compared to the less flat floor. Therefore, cleaning an uneven floor requires faster reciprocating movement (that is, higher frequency) of the cleaning head 410 and a larger amount of liquid (such as water).

For another example, when the autonomous cleaning device is in operation on a desktop, the preset reciprocating cycle may be automatically and dynamically adjusted to be longer, and the liquid volume of the pump may be automatically and dynamically adjusted to be smaller. When the autonomous cleaning device 100 is in operation on the floor, the preset reciprocating cycle may be automatically and dynamically adjusted to be shorter, and the liquid volume of the pump may be automatically and dynamically adjusted to be greater. This is because compared to the floor, the desktop has less dust and oil, and it is easier to clean a material of the desktop. Therefore, the cleaning head 410 is required to perform less reciprocating movements and the pump provides relatively less liquid (such as water) to clean the desktop.

Figure 16:
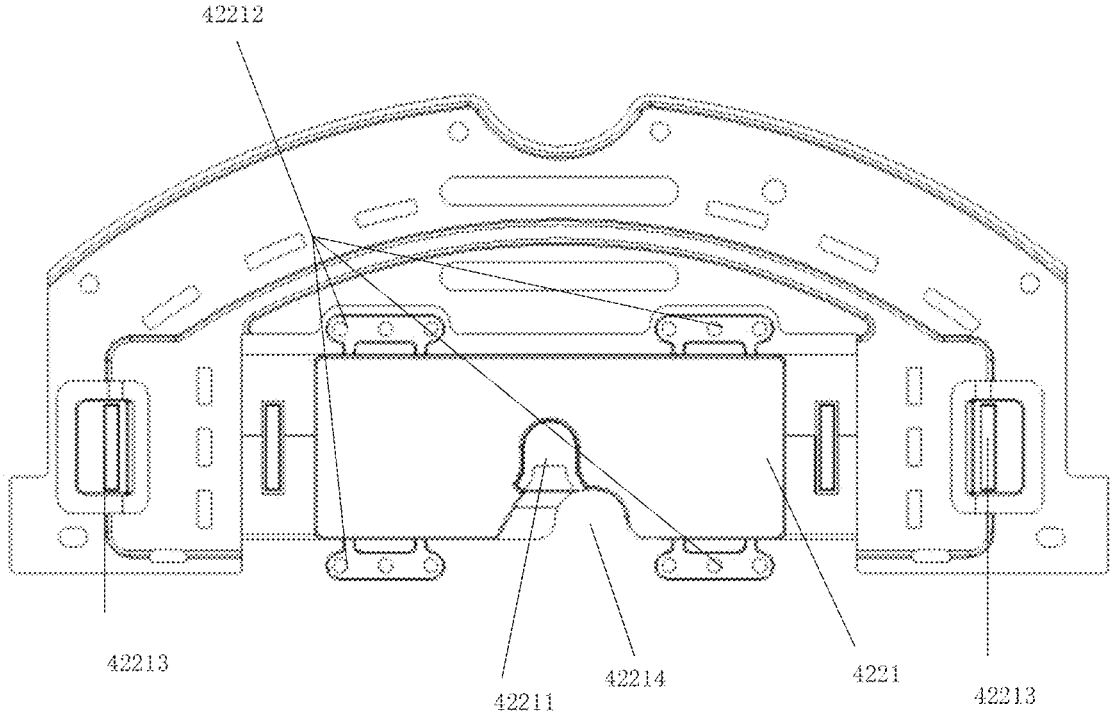
FIG. 16 illustrates a schematic structural view of a cleaning base plate in an assembled state according to an embodiment of the present disclosure.

As an optional embodiment of the present disclosure, the support platform 422 includes: a cleaning base plate 4221, which is disposed on the support platform 422 in a freely movable mode. The cleaning base plate 4221 substantively conducts reciprocating movement under vibration of the vibration member 4213. Optionally, as illustrated in FIG. 16, the cleaning base plate 4221 includes an assembly notch 42211 disposed at a position in contact with the vibration member 4213. When the support platform 422 is connected to the driving platform 421, the vibration member 4213 is fitted in the assembly notch 42211, so that the cleaning base plate 4221 can substantially conduct reciprocating movement synchronously along with the vibration member 4213. In the travelling direction of the cleaning device, there are four first stoppers 42212 on the cleaning base plate 4221 in the travelling direction of the cleaning device. The four first stoppers 42212 are in soft connection with the cleaning base plate 4221, and the soft connection can be deformed in a small scope, thereby limiting the movement of the cleaning base plate 4221 relative to the support platform 422 in the travelling direction of the autonomous cleaning device. There are two second stoppers 42213 in a direction of the cleaning base plate 4221 perpendicular to the travelling direction of the autonomous cleaning device. The two second stoppers 42213 defines a range of reciprocating movement of the cleaning base plate in the direction perpendicular to the travelling direction of the autonomous cleaning device. In addition, a liquid outlet hole 42214 is disposed near the assembly notch 42211 of the cleaning base plate 4221, such that the liquid discharged from the liquid outlet device 4217 flows to the cleaning head 410 through the liquid outlet hole. Due to influences of the stoppers and the vibration buffer device, the movement of the cleaning base plate 4221 is substantively reciprocating movement. The cleaning base plate 4221 is located on a part of the support platform 422, and a vibration frequency may be increased by means of local vibration, for example, reaching an acoustic wave frequency range. Movement is restricted in the travelling direction of the robot through the less elastic connection between the movable part and the fixed part of the driving platform 421, while movement is allowed in the direction substantially perpendicular to the travelling direction, that is, movement is allowed in the vibration direction of the vibration member 4213 through the flexible connection.

Figure 12:
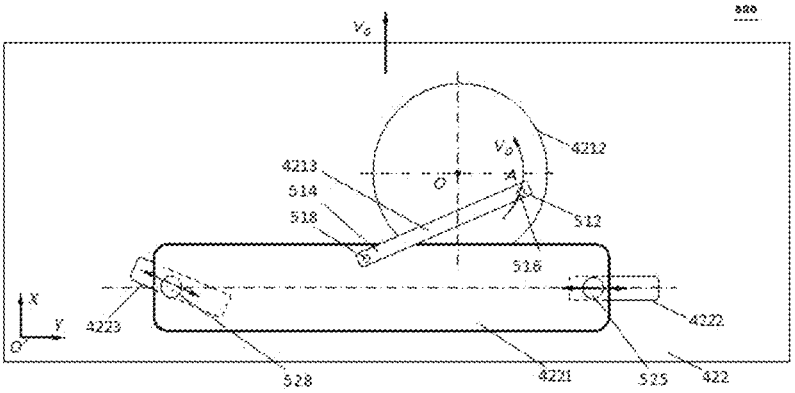
FIG. 12 illustrates a schematic view of a cleaning head driving mechanism based on a crank-slider mechanism according to another embodiment of the present disclosure.

FIG. 12 illustrates a cleaning head driving mechanism 800 based on a crank-slider mechanism according to another embodiment of the present disclosure. The driving mechanism 800 is applicable to the driving platform 421. The driving mechanism 800 includes a driving wheel 4212, a vibration member 4213, a cleaning base plate 4221, a sliding groove 4222 (a first sliding groove), and a sliding groove 4223 (a second sliding groove).

The sliding grooves 4222, 4223 are provided on the support platform 422. Both ends of the cleaning base plate 4221 respectively include a slider 525 (a first slider) and a slider 528 (a second slider). The sliders 525 and 528 are respectively protrusions on both ends of the cleaning base plate 4221. The slider 525 is inserted into the sliding groove 4222 and is slideable along the sliding groove 4222. The slider 4223 is inserted into the sliding groove 4223 and is slideable along the sliding groove 4223. In some embodiments of the present disclosure, the sliding groove 4222 and the sliding groove 4223 are located on one straight line. In some embodiments of the present disclosure, the sliding groove 4222 and the sliding groove 4223 are not located on one straight line. In some embodiments of the present disclosure, the sliding groove 4222 and the sliding groove 4223 extend in a same direction. In some embodiments of the present disclosure, an extending direction of the sliding groove 4222 and the sliding groove 4223 is the same as an extending direction of the cleaning base plate 4221. In some embodiments of the present disclosure, the extending direction of the sliding groove 4222 and the sliding groove 4223 is different from the extending direction of the cleaning base plate 4221. In some embodiments of the present disclosure, the extending direction of the sliding groove 4222 is different from the extending direction of the sliding groove 4223. For example, as illustrated in FIG. 12, the extending direction of the sliding groove 4222 is the same as the extending direction of the cleaning base plate 4221, while the extending direction of the sliding groove 4223 is at a certain angle with respect to the extending direction of the sliding groove 4222.

The vibration member 4213 includes a swinging end 512 and a sliding end 514. The swinging end 512 is connected to the driving wheel 4212 through a first pivot 516, and the sliding end 514 is connected to the cleaning base plate 4221 through a second pivot 518.

A swing center of the driving wheel 4212 is point O, and a pivotal center of the first pivot 516 is point A. The point O and the point A do not coincide with each other, and a distance between them is a preset distance d.

When the driving wheel 4212 rotates, the point A performs a circular swing movement therewith. Accordingly, the swinging end 512 performs a circular swing movement along with the point A. The sliding end 514 drives the cleaning base plate 4221 to perform a sliding movement through the second pivot 518. Accordingly, the slider 525 of the cleaning base plate 4221 performs a linear reciprocating movement along the sliding groove 4222; and the slider 528 performs the linear reciprocating movement along the sliding groove 4223. In FIG. 4, the moving speed of the mobile platform 210 is V0, and the moving direction is a target direction. According to some embodiments of the present disclosure, when the sliding groove 4223 and the sliding groove 4222 are respectively approximately perpendicular to a direction of the moving speed V0 of the mobile platform 210, an overall displacement of the cleaning base plate 4221 is substantially perpendicular to the target direction. According to other embodiments of the present disclosure, when any one of the sliding groove 4223 and the sliding groove 4222 have an angle other than 90 degrees with respect to the target direction, overall displacement of the cleaning base plate 4221 includes both a component perpendicular to the target direction and a component parallel to the target direction.

Further, the cleaning head driving mechanism further includes a vibration buffer device 4215, which is disposed on the connection rod 4214 and is configured to reduce the vibration in a certain direction. In an embodiment of the present disclosure, the vibration buffer device 4215 is configured to reduce vibration in the direction of the movement component perpendicular to the target direction of the autonomous cleaning device.

Figure 13:
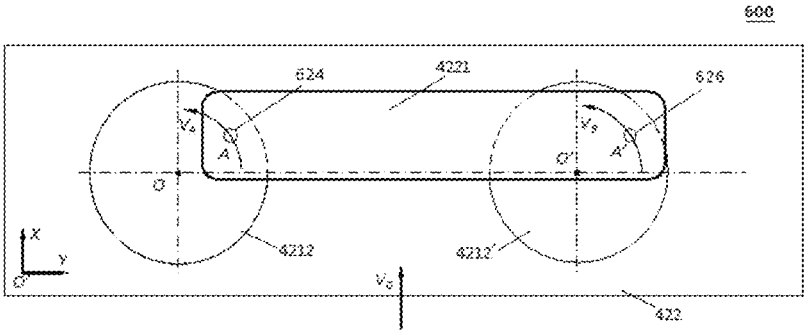
FIG. 13 illustrates a schematic view of a cleaning head driving mechanism based on a double crank mechanism according to another embodiment of the present disclosure.

FIG. 13 illustrates a cleaning head driving mechanism 600 based on a double crank mechanism according to another embodiment of the present disclosure. The driving mechanism 600 is applicable to the driving platform 421. The driving mechanism 600 includes a driving wheel 4212 (a first driving wheel), a driving wheel 4212' (a second driving wheel), and a cleaning base plate 4221.

The cleaning base plate 4221 has two ends, wherein a first end is connected to the driving wheel 4212 through a pivot 624 (a first pivot), and a second end is connected to the driving wheel 4212' through a pivot 626 (a second pivot). A swing center of the driving wheel 4212 is point O, and a pivotal center of the pivot 624 is point A. The point O and the point A do not coincide with each other, and a distance between them is a preset distance d. A swing center of the driving wheel 236 is point O', and a pivotal center of the pivot 626 is point A'. The point O' and the point A' do not coincide with each other, and a distance between them is the preset distance d. In some embodiments of the present disclosure, the point A, the point A', the point O and the point O' are located on the same plane. Therefore, the driving wheel 4212, the driving wheel 4212' and the cleaning base plate 4221 forms a double crank mechanism (or a parallelogram mechanism), where the cleaning base plate 4221 serves as a coupling rod and the driving wheels 4212, 4212' act as two cranks.

Further, the cleaning head driving mechanism includes a vibration buffer device 4215, which is disposed on the connection rod 4214, and is configured to reduce vibration in a certain direction. In an embodiment of the present disclosure, the vibration buffer device 4215 is configured to reduce vibration in the direction of the movement component perpendicular to the target direction of the autonomous cleaning device.

Figure 14:
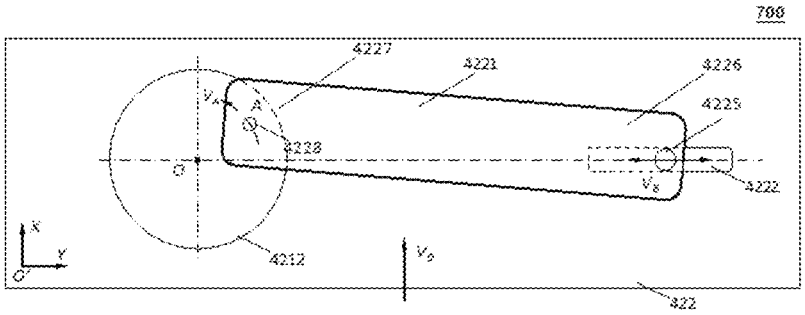
FIG. 14 illustrates a schematic view of a cleaning head driving mechanism based on a crank mechanism according to another embodiment of the present disclosure.

FIG. 14 illustrates a cleaning head driving mechanism 700 based on a crank-slider mechanism according to an embodiment of the present disclosure. The cleaning head driving mechanism 700 is applicable to the driving platform 421, and includes a driving wheel 4212, a cleaning base plate 4221 and a sliding groove 4222.

The sliding groove 4222 is provided on the support platform 422. The cleaning base plate 4221 includes a swinging end 4227 and a sliding end 4226. The swinging end 4227 is connected to the driving wheel 4212 through a pivot 4228. A swing center of the driving wheel 4212 is point O, and a pivotal center of the pivot 4228 of the swinging end is point A. The point O and the point A do not coincide with each other, and a distance between them is a preset distance d. The sliding end 4226 includes a slider 4225 that is a protrusion on the sliding end 4226. The slider 4225 is inserted into the sliding groove 4222 and is slideable along the sliding groove 4222. Therefore, the driving wheel 4221, the cleaning base plate 4221, the slider 4225 and the sliding groove 4222 form a crank-slider mechanism.

When the driving wheel 4212 rotates, the point A conducts a circular swing movement. Accordingly, the swinging end 4227 of the cleaning base plate 4221 performs a circular swing movement along with the point A. The slider 4225 slides in the sliding groove 4222 to conduct a linear reciprocating movement. As a result, the cleaning base plate 4221 starts to conduct reciprocating movement. According to some embodiments of the present disclosure, the sliding groove 4222 is approximately perpendicular to the target direction of the moving speed of the mobile platform. Therefore, the linear movement of the sliding end 4226 includes a component perpendicular to the target direction, and the circular swing movement of the swinging end 4227 includes both a component perpendicular to the target direction and a component parallel to the target direction.

In FIG. 14, the moving speed of the mobile platform is V0, and the moving direction is the target direction. The sliding groove 4222 is approximately perpendicular to the target direction. At this time, the reciprocating movement of the cleaning base plate 4221 as a whole has a motion component parallel to the target direction of the autonomous cleaning device and a motion component perpendicular to the target direction of the autonomous cleaning device.

Further, the cleaning head driving mechanism includes a vibration buffer device 4215, which is disposed on the connection rod 4214, and is configured to reduce the vibration in a certain direction. In an embodiment of the present disclosure, the vibration buffer device 4215 is configured to reduce the vibration in the direction of the movement component perpendicular to the target direction of the autonomous cleaning device.

Further, the support platform 422 further includes an elastic detachment button 4229, disposed on at least one side of the support platform 422, and configured to detachably connect the support platform 422 to a claw 4216 of the driving platform 421. At least one fitting section 4224 is disposed on the support platform 422 for fitting the cleaning head 410. The fitting section 4224 may be formed of an adhesive layer having adhesive material.

As an optional embodiment of the present disclosure, as illustrated in FIG. 9, the cleaning head 410 includes a movable section 412 connected to the cleaning base plate 4221 and conducting reciprocating movement along the cleaning surface under driving of the cleaning base plate 4221. The movable section 412 is disposed at a substantially central position of the cleaning head 410. Optionally, an adhesive layer is disposed on a side of the movable section 412 connected to the cleaning base plate 4221. The movable section 412 and the cleaning base plate 4221 are connected through the adhesive layer.

Optionally, the cleaning head 410 further includes a fixed section 411, connected to the bottom part of the support platform 422 through the at least one fitting section 4224. The fixed section 411 cleans at least part of the cleaning surface with movement of the support platform 422.

Further, the cleaning head 410 further includes a flexible connection part 413, disposed between the fixed section 411 and the movable section 412 and configured to connect the fixed section 411 with the movable section 412. The cleaning head 410 further includes a sliding buckle 414, extending along an edge of the cleaning head 410 and detachably mounted at a buckle position 4225 of the support platform 422.

In an embodiment of the present disclosure, As illustrated in FIG. 9, the cleaning head 410 may be made of a material having certain elasticity, and the cleaning head 410 is fixed to a surface of the support platform 422 through the adhesive layer, so as to achieve the reciprocating movement. When the cleaning head 410 is in operation, the cleaning head 410 is kept in contact with the surface to be cleaned.

The liquid delivery mechanism includes a liquid outlet device 4217, which may be directly or indirectly connected to a cleaning liquid outlet of the liquid container (not illustrated), such as a liquid outlet of the clean water container. The cleaning liquid may flow to the liquid outlet device 4217 via the cleaning liquid outlet of the liquid container, and may be evenly sprayed onto the surface to be cleaned through the liquid outlet device. The liquid outlet device may be provided with a connection piece (not illustrated in the figure), and the liquid outlet device is connected to the cleaning liquid outlet of the liquid container through the connection piece. The liquid outlet device is provided with a distribution opening, which may be a continuous opening or a combination of several small discontinuous openings. Several nozzles may be disposed at the distribution opening. The cleaning liquid flows to the distribution opening through the cleaning liquid outlet of the liquid container and the connection piece of the liquid outlet device, and is evenly sprayed onto the cleaning surface through the distribution opening.

The liquid delivery mechanism may further include a pump 4219 and/or a pump pipe 4218. The pump 4219 may directly communicate with the cleaning liquid outlet of the liquid container or communicate with it through the pump pipe 4218.

The pump 4219 may be connected to the connection piece of the liquid outlet device, and may be configured to pump the cleaning liquid from the liquid container to the liquid outlet device. The pump can be a gear pump, a vane pump, a plunger pump, a peristaltic pump, and so on.

The liquid delivery mechanism pumps out the cleaning liquid in the liquid container through the pump 4219 and the pump pipe 4218, and then deliver the cleaning liquid to the liquid outlet device. The liquid outlet device 4217 may be a nozzle, a drip hole, a soaking cloth, etc., and evenly spread liquid on the cleaning head, so as to wet the cleaning head and the surface to be cleaned. Stains on the wet surface to be cleaned may be cleaned more easily. In the wet cleaning module 400, power or flow rate of the pump may be adjusted.

Figure 17:
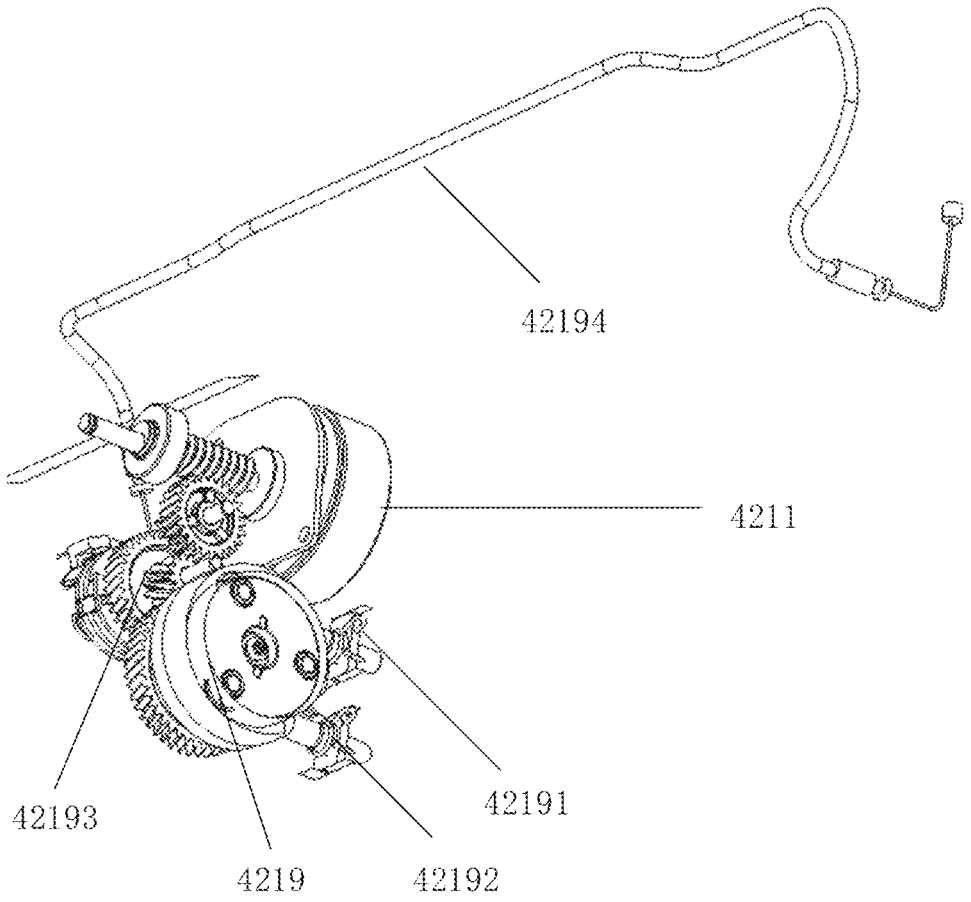
FIG. 17 illustrates a structural view of a motor-driven pump according to an embodiment of the present disclosure.

Further, as illustrated in FIG. 17, the motor 4211 drives the pump 4219 to peristalize through a gear set 42193. Due to the peristaltic movement of the pump 4219, liquid enters from the liquid inlet 42191, flows out from the liquid outlet 42192, and is then delivered to the liquid outlet device 4217 via the pump pipe 4218. The liquid flowing out through the liquid outlet device 4217 flows to the cleaning head 410 through the liquid outlet hole.

Figure 18:
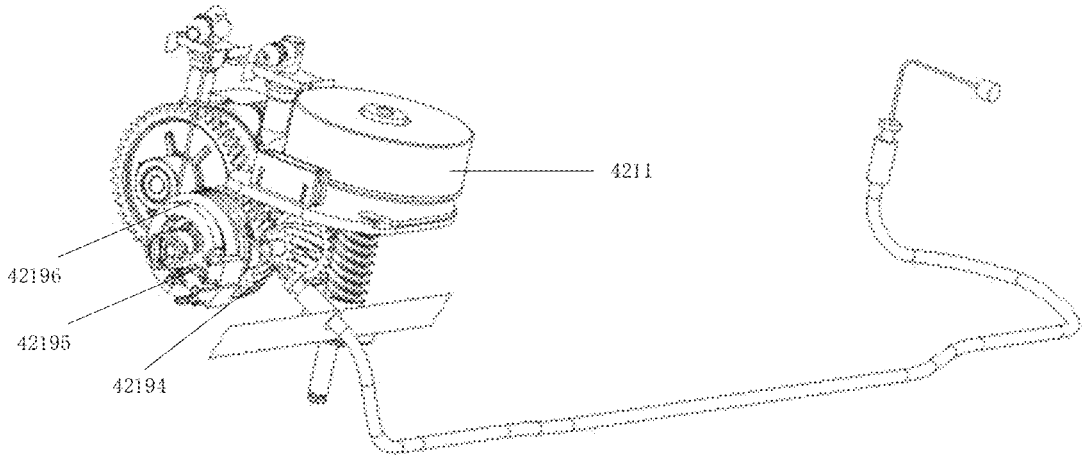
FIG. 18 illustrates a structural view of a motor-driven lifting module according to an embodiment of the present disclosure.

Further, as illustrated in FIG. 18, the motor 4211 drives a cable gear 42196 to rotate through the gear set 42193, the cable gear 42196 is wound with a cable 42194, the cable 42194 is wrapped on the driving platform 421, and the cable gear 42196 draws the cable 42194 to raise up or lower down, thereby move the driving platform 421 upwards or downwards.

The gear set 42193 and the cable gear 42196 are provided with a clutch 42195. By controlling clutching of the clutch 42195, the motor 4211 controls three motion modules. For example, the motor 4211 rotates in one direction to drive the vibration member to vibrate, and achieve liquid supply of the pump 4219, and the motor 4211 rotates in an opposite direction to drive the lifting module up or down through the cable 42194. Optionally, a combination scheme of the gear set realizes different combinations of control over the three motion modules. For example, rotation of the motor in one direction achieves liquid supply by the pump, and the rotation of the motor in the opposite direction achieves control on the lifting and the vibration. Optionally, two motors may be also used to control the three motion modules.

Since the cleaning module of the autonomous cleaning device is provided with a dry cleaning module and a wet cleaning module, a more comprehensive cleaning function may be provided. In addition, in the wet cleaning module, the cleaning head may conduct reciprocating movement by combining a driving unit and a vibration section. Thus, the surface to be cleaned can be repeatedly cleaned, so that in the movement trajectory of the cleaning robot, a certain area can be cleaned multiple times at one time. This thereby greatly enhances the cleaning effect. Especially for areas with more stains, the cleaning effect is pronounced.

Figure 19:
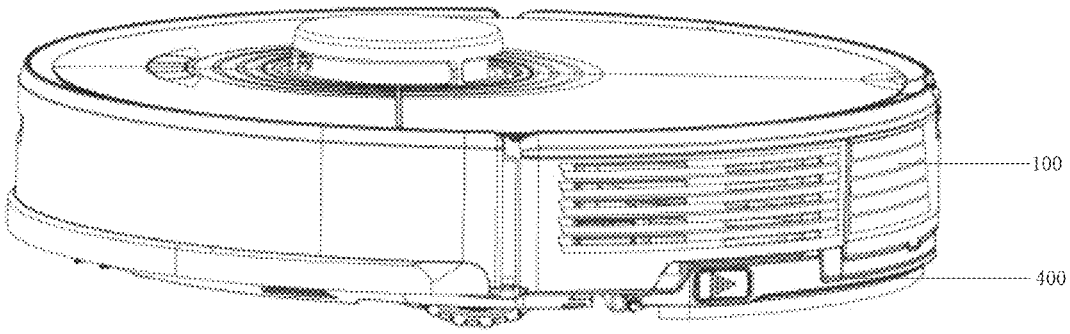
FIG. 19 illustrates a schematic view of an autonomous cleaning device in a raised state according to an embodiment of the present disclosure.
Figure 20:
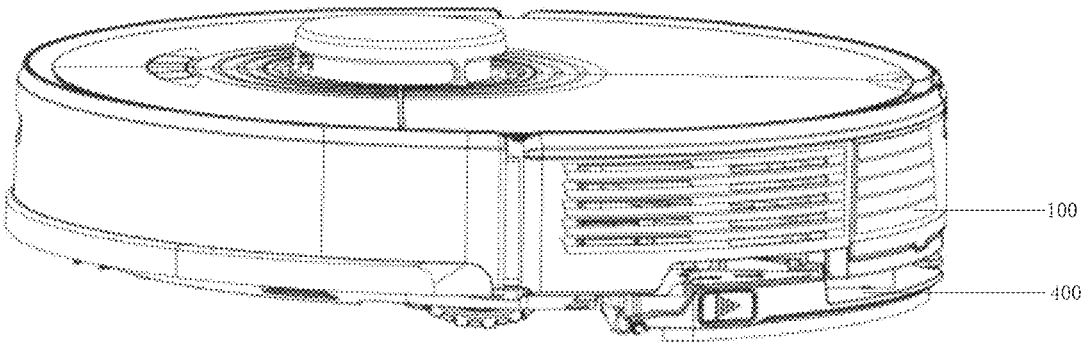
FIG. 20 illustrates a schematic view of an autonomous cleaning device in a lowered state according to an embodiment of the present disclosure.

As illustrated in FIGS. 19-20, the wet cleaning module 400 is movably connected to the mobile platform 100 through a four-linkage lifting structure 500, and is configured to clean at least part of the cleaning surface in the wet cleaning mode. The four-linkage lifting structure 500 is a parallelogram structure, and is configured to switch the wet cleaning module 400 between a rised state and a lowered state. The rised state is a state where the wet cleaning module 400 leaves the cleaning surface, as illustrated in FIG. 19. The lowered state is a state where the wet cleaning module 400 is attached onto the cleaning surface, as illustrated in FIG. 20.

Figure 21:
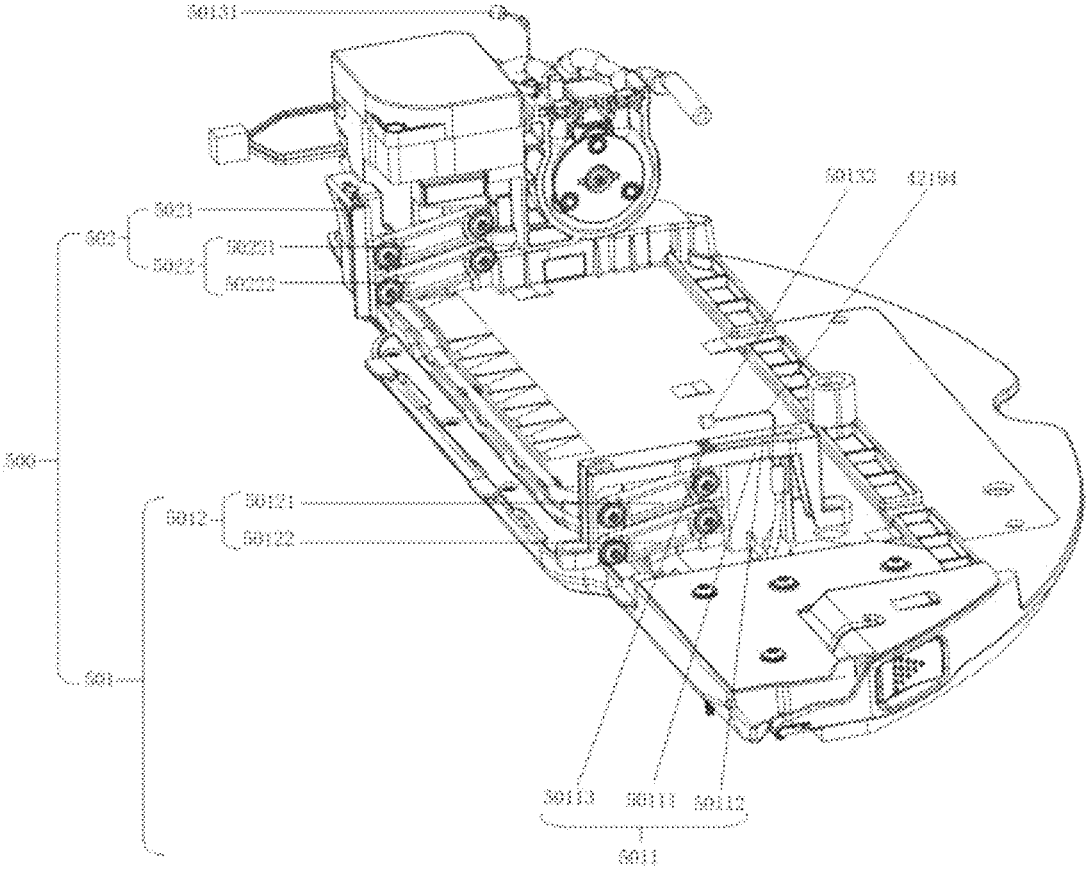
FIG. 21 illustrates a schematic view of a four-linkage lifting structure in a raised state according to an embodiment of the present disclosure.
Figure 22:
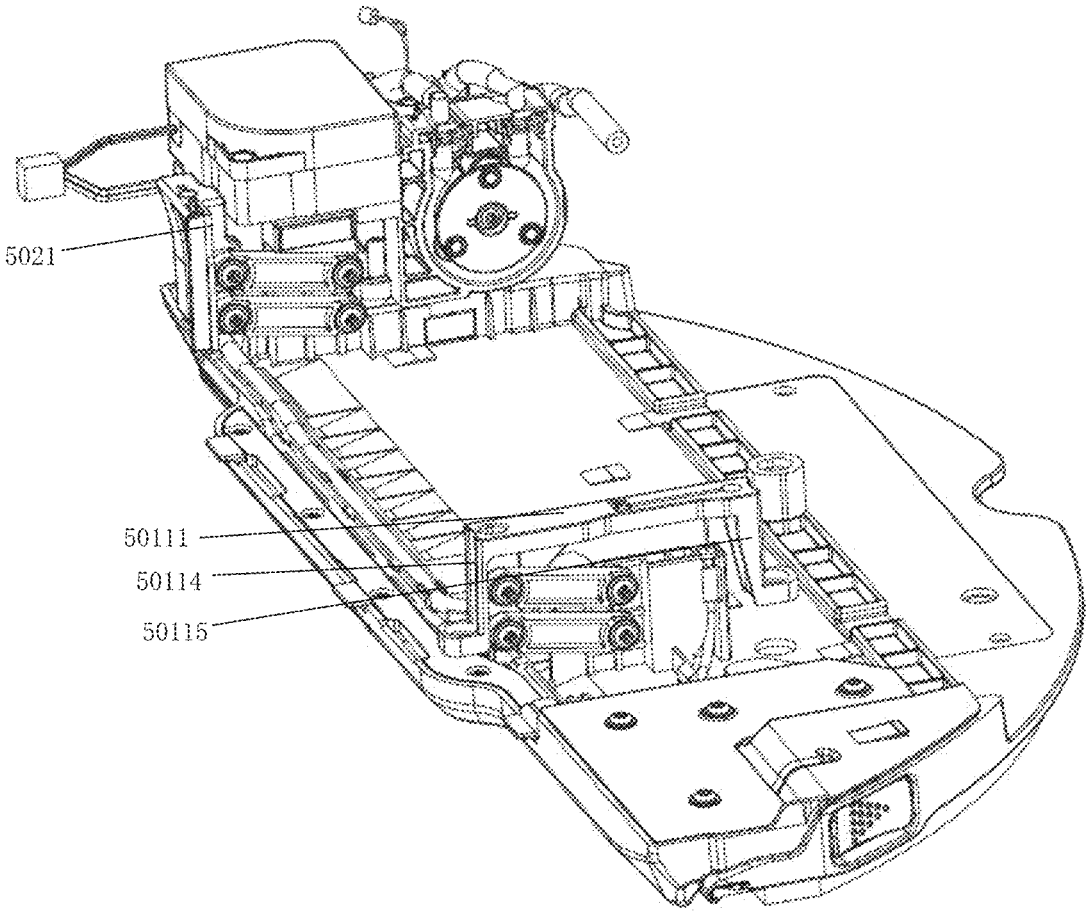
FIG. 22 illustrates a schematic view of a four-linkage lifting structure in a lowered state according to an embodiment of the present disclosure.

As illustrated in FIGS. 21-22, the four-linkage lifting structure 500 includes: a first connection end 501, configured to provide an active force to switch the wet cleaning module 400 between the rised state and the lowered state, and a second connection end 502, disposed opposite to the first connection end 501, and rotating under action of the active force. The first connection end 501 and the second connection end 502 are respectively located on each side of the wet cleaning module 400, and raises or lowers the wet cleaning module 400 by stably providing a lifting force.

In an embodiment of the present disclosure, the first connection end 501 includes a first holder 5011 fixedly connected to a bottom part of the mobile platform 100. The first holder 5011 has a substantively n-shaped structure. The first holder 5011 includes a transverse beam 50111, a first longitudinal beam 50114, and a second longitudinal beam 50115. Ends of the first longitudinal beam 50114 and the second longitudinal beam 50115 are respectively fixedly connected to the mobile platform 100 by bolts, so as to provide a support force when the wet cleaning module 400 is being raised and lowered.

The first connection end 501 further includes a first pair of connection rods 5012, having one end rotatably connected to the first holder 5011, and the other end rotatably connected to the wet cleaning module 400. The first pair of connection rods 5012 may have a hollow-out structure, which helps to reduce overall weight of a lifting end.

Optionally, the first pair of connection rods 5012 includes a first connection rod 50121 and a second connection rod 50122 disposed in parallel. First ends of the first connection rod 50121 and the second connection rod 50122 are rotatably connected to the first longitudinal beam 50114 through movable studs, and second ends of the first connection rod 50121 and the second connection rod 50122 are also rotatably connected to the wet cleaning module 400 through movable studs. For example, both ends of the first connection rod 50121 and the second connection rod 50122 are respectively provided with a through hole with a diameter larger than that of the movable stud, so that the movable stud may rotate freely in the through hole, and the movable stud passes through the through hole to be fixedly connected to the first longitudinal beam 50114. When the motor 4211 provides a pulling force to the first end through the cable, the first ends of the first connection rod 50121 and the second connection rod 50122 rotate around the movable studs at the first ends at the same time, and the second end is raised up under action of the pulling force by the cable, so as to raise up the wet cleaning module 400. When the motor 4211 releases the pulling force to the first end through the cable, the first ends of the first connection rod 50121 and the second connection rod 50122 rotate in an opposite direction around the movable studs at the first ends at the same time, and the second end is lowered under action of the gravity, so as to lower down the wet cleaning module 400.

The lifting structure 500 further includes the cable 42194 configured to provide the pulling force, such that the first pair of connection rods 5012 rotates within a preset angle. The cable 42194 includes a first terminal of the cable 50131 connected to the driving unit 420. For example, the first terminal of the cable 50131 is connected to a gear in a winding way, which is connected to the output shaft of the motor, so as to achieve rising or lowering under rotation of the motor. A terminal of cable at holder 50132 is connected to the first holder 5011, and the motor causes the second ends of the first connection rod 50121 and the second connection rod 50122 to rise up or lower down through the cable 42194.

Optionally, the first holder 5011 further includes: a sliding groove 50112 that extends along a surface of the transverse beam 50111, and a buckle hole 50113 that penetrates through the transverse beam 50111 and is disposed at an end of the sliding groove 50112, and is configured to receive and buckle the terminal cable at holder 50132. The cable 42194 is connected to the first ends of the first connection rod 50121 and the second connection rod 50122 through the sliding groove 50112 and the buckle hole 50113. The sliding groove 50112 helps to restrict a moving direction of the cable to provide stability of raising up and lowering down of the module. A width of the sliding groove matches a thickness of the cable.

As illustrated in FIGS. 21-22, the second connection end 502 includes: a second holder 5021, fixedly connected to the bottom part of the mobile platform 100; and a second pair of connection rods 5022, having one end rotatably connected to the second holder 5021, and the other end rotatably connected to the wet cleaning module 400. The second pair of connection rods 5022 rotates as the first pair of connection rods 5012 rotates. The second pair of connection rods 5022 may have a hollow-out structure, which helps to reduce the overall weight of the lifting end.

In an embodiment of the present disclosure, the second pair of connection rods 5022 includes a third connection rod 50221 and a fourth connection rod 50222 disposed in parallel. First ends of the third connection rod 50221 and the fourth connection rod 50222 are rotatably connected to the second holder 5021 through movable studs. Second ends of the third connection rod 50221 and the fourth connection rod 50222 are rotatably connected to the wet cleaning module 400 through movable studs. For example, both ends of the third connection rod 50221 and the fourth connection rod 50222 are respectively provided with a through hole with a diameter greater than that of the movable stud, so that the movable stud may rotate freely in the through hole, and the movable stud passes through the through hole to be fixedly connected to the second holder 5021. When the first connection end 501 is driven by the motor 4211 to rotate, the first ends of the third connection rod 50221 and the fourth connection rod 50222 simultaneously rotate around the movable stud at the first end, and the second ends of the third connection rod 50221 and the fourth connection rod 50222 simultaneously rotates around the movable stud at the second end, so that the wet cleaning module 400 is raised up. When the first connection end 501 releases the pulling force, the third connection rod 50221 and the fourth connection rod 50222 rotate in an opposite direction around the movable stud at the same time, and descend under action of gravity, so that the wet cleaning module 400 is lowered down.

Through the four-linkage lifting structure disposed between the wet cleaning module and the mobile platform, the wet cleaning module may be raised up and lowered down with respect to the mobile platform. When the mopping operation is performed, the wet cleaning module is lowered down to make the wet cleaning module in contact with the floor. When the mopping operation is completed, the wet cleaning module is raised up to separate the wet cleaning module from the floor and to avoid the increased resistance due to the presence of the cleaning module when the cleaning device moves freely on the surface to be cleaned.

In conjunction with sensors such as a surface media sensor that is capable of detecting a surface type of the surface to be cleaned, the lifting module helps to enable the wet cleaning module to perform the cleaning operation according to different surfaces to be cleaned. For example, the lifting module raises up the wet cleaning module up on a carpet surface, and lowers down the wet cleaning module down on a surface such as a floor or floor tile, so as to perform cleaning operation and obtain a more comprehensive cleaning effect.

Figure 23:
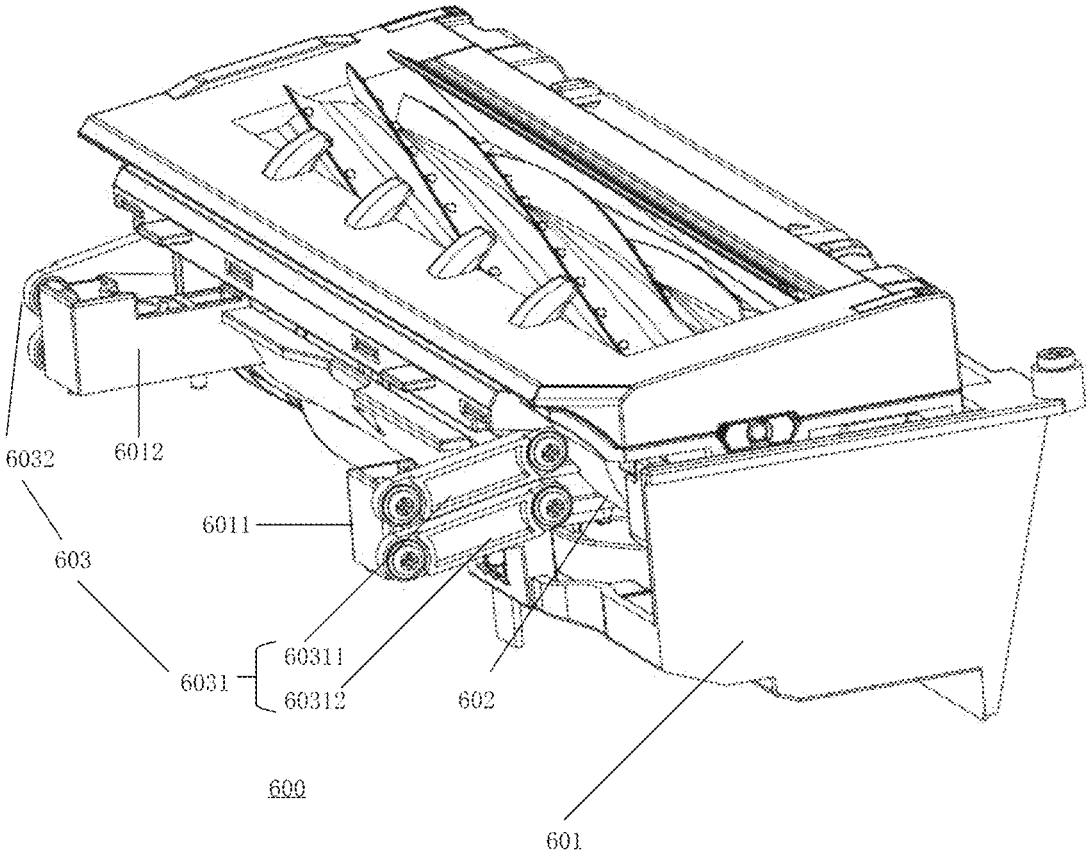
FIG. 23 illustrates a schematic structural view of a dry cleaning module in a lowered state according to an embodiment of the present disclosure.

As illustrated in FIG. 23, which is a state view when the dry cleaning module 151 is raised up, a float lifting structure 600 is connected to the dry cleaning module 151 and configured to enable the dry cleaning module 151 to move up and down passively with respect to the mobile platform 100. For example, the float lifting structure 600 is a parallelogram four-linkage lifting structure, configured to passively switch the dry cleaning module 151 between the rised state and the lowered state under action of an external force.

Optionally, the float lifting structure 600 includes: a first fixed holder 601 fixedly connected to the mobile platform 100; a second fixed holder 602 fixedly connected to the dry cleaning module 151; and a pair of connection rods 603, having one end rotatably connected to the first fixed holder 601 through a movable stud, and the other end rotatably connected to the second fixed holder 602 through a movable stud. The first fixed holder 601 and the second fixed holder 602 are connected by a flexible connection part. When the obstacle is encountered, the dry cleaning module 151 is lifted upwards, and the first fixed holder 601 rotates around the pair of connection rods 603 and then is stowed upwards with respect to the second fixed holder 602, thereby realizing the passive lifting. After crossing over the obstacle, the dry cleaning module 151 falls under action of gravity and becomes contact with the cleaning surface, and the cleaning device continues to move forward for performing the cleaning operation. The parallelogram four-linkage lifting structure enables the cleaning device to cross over the obstacle more flexibly and be not easy to be damaged.

Optionally, the pair of connection rods 603 includes: a first pair of connection rods 6031, having one end rotatably connected to a first end of the first fixed holder 601 through a movable stud, and the other end rotatably connected to a first end of the second fixed holder 602 through a movable stud; and a second pair of connection rods 6032 disposed opposite to the first pair of connection rods 6031, having one end rotatably connected to a second end of the first fixed holder 601 through a movable stud, and the other end rotatably connected to a second end of the second fixed holder 602 through a movable stud. The first pair of connection rods 6031 or the second pair of connection rods 6032 may have a hollow-out structure, which helps to reduce the overall weight of the lifting end.

Optionally, the first pair of connection rods 6031 includes a first connection rod 60311 and a second connection rod 60312 disposed in parallel. One ends of the first connection rod 60311 and the second connection rod 60312 are provided with a first shaft hole, and the other ends thereof are provided with a second shaft hole. The movable stud passes through the first shaft hole, such that the first connection rod 60311 and the second connection rod 60312 are rotatably fixed to the first end of the first fixed holder 601. The movable stud passes through the second shaft hole, such that the first connection rod 60311 and the second connection rod 60312 are rotatably fixed to the first end of the second fixed holder 602. For example, both ends of the first connection rod 60311 and the second connection rod 60312 are respectively provided with a buckle hole (not illustrated) having a diameter larger than that of the movable stud, so that the movable stud may rotate freely in the buckle hole, and the movable stud passes through the buckle hole to be fixedly connected to the first fixed holder 601. When a bumpy obstacle is encountered, the dry cleaning module 151 is lifted upward under action of the obstacle, and the first ends of the first connection rod 60311 and the second connection rod 60312 rotate around the movable stud at the first end at the same time, and the second ends of the first connection rod 60311 and the second connection rod 60312 rotate around the movable stud at the second end at the same time, so that the dry cleaning module 151 is raised up. After crossing over the obstacle, the dry cleaning module 151 falls down under action of gravity and becomes in contact with the cleaning surface.

Figure 24:
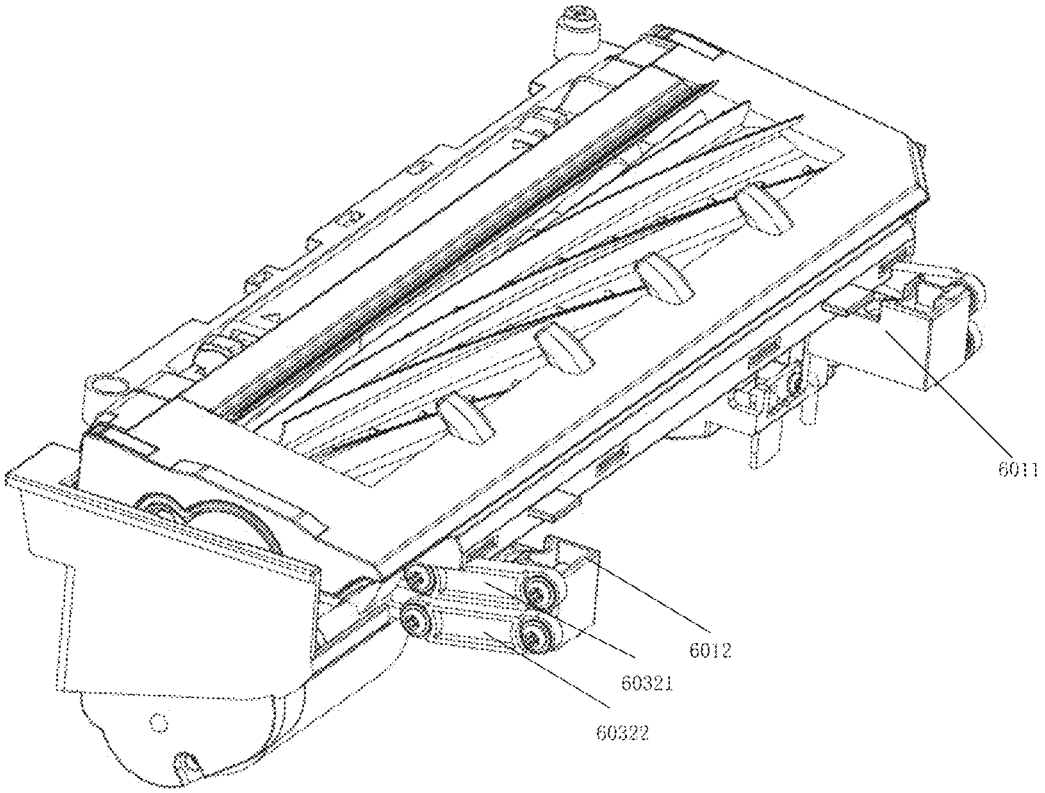
FIG. 24 illustrates a schematic structural view of a dry cleaning module in a raised state according to an embodiment of the present disclosure.

Optionally, as illustrated in FIG. 24, which illustrates a state view when the dry cleaning module 151 is raised up, the second pair of connection rods 6032 includes a third connection rod 60321 and a fourth connection rod 60322 disposed in parallel. One ends of the three connection rod 60321 and the fourth connection rod 60322 are provided with a third shaft hole, and the other ends of the three connection rod 60321 and the fourth connection rod 60322 are provided with a fourth shaft hole. The movable stud passes through the third shaft holes, such that the third connection rod 60321 and the fourth connection rod 60322 are rotatably fixed to the second end of the first fixed holder 601. The movable stud passes through the fourth shaft holes, such that the third connection rod 60321 and the fourth connection rod 60322 are rotatably fixed to the second end of the second fixed holder 602. For example, both ends of the third connection rod 60321 and the fourth connection rod 60322 are respectively provided with a buckle hole (not illustrated) having a diameter larger than that of the movable stud, so that the movable stud may rotate freely in the buckle hole, and the movable stud passes through the buckle hole to be fixedly connected to the first fixed holder 601. When a bumpy obstacle is encountered, the dry cleaning module 151 is lifted upward under action of the obstacle, and the first ends of the third connection rod 60321 and the fourth connection rod 60322 rotate around the movable stud at the first end at the same time, and the second ends of the third connection rod 60321 and the fourth connection rod 60322 rotate around the movable stud at the second end at the same time, so that the dry cleaning module 151 is raised up. After crossing over the obstacle, the dry cleaning module 151 falls down under action of gravity and becomes contact with the cleaning surface.

As an optional embodiment of the present disclosure, the first fixed holder 601 includes: a first fixed portion 6011, protruding from the first fixed holder 601 and extending outwards laterally, and configured to carry the first pair of connection rods 6031; and a second fixed portion 6012, disposed symmetrical to the first fixed portion 6011, and configured to carry the second pair of connection rods 6032. The first fixed portion 6011 and the second fixed portion 6012 are configured to protrudedly support the pairs of connection rods, so that the pairs of connection rods may rotate freely, thereby ensuring free lifting up and descending of the dry cleaning module 151.

Optionally, the float lifting structure 600 further includes a flexible connection part (not illustrated) connected between the first fixed holder 601 and the second fixed holder 602. When the cleaning surface is uneven, the second fixed holder 602 moves upward or downward with respect to the first fixed holder 601 through the flexible connection part.

In the dry cleaning module, with the four-linkage float lifting structure, the dry cleaning module can passively move upward or downward with respect to the mobile platform. When the cleaning device encounters an obstacle during operation, it can easily cross over the obstacle by means of the four-linkage float lifting structure, thus avoiding damage to the cleaning device.

With the development of sweeping robots, the existing sweeping robots have been evolved into cleaning robots in which the dry and wet cleaning functions are incorporated. A cleaning robot 2000 may be equipped with both a dry cleaning module 151 and a wet cleaning module 400. During the cleaning process, the dry cleaning module 151 is located at a front end relative to the wet cleaning module 400 along a travelling direction so as to clean the floor; and the wet cleaning module 400 is located behind the dry cleaning module 151 along the travelling direction. Thus, the floor may be mopped after the dry cleaning module 151 has finished cleaning. However, the wet cleaning module 400 generally cannot be used for cleaning the carpet.

In practical applications, in order to prevent the wet cleaning module 400 from wetting a carpet, a lifting mechanism for the wet cleaning module is typically disposed on the cleaning robot 2000. In this way, when a surface media sensor 103 of the cleaning robot 2000 identifies a carpet, the wet cleaning module may be raised up. This enable the wet cleaning module to not touch the carpet when the cleaning robot 2000 passes over the carpet. When it is detected that the cleaning robot has left the carpet, the wet cleaning module 400 may be lowered down again to mop the floor.

However, due to a height limitation of the cleaning robot 2000, a lifting range of the wet cleaning module 400 is very small, typically only about 1 mm. For carpets with long piles, mats, or clothing, etc., it is difficult to prevent the above items from getting wet, even if the wet cleaning module 400 is raised up, and the cleaning robot 2000 may even become stuck and unable to move.

In view of above, an embodiment of the present disclosure provides a method of a cleaning robot escaping from a trapped state, which may be applied in a situation where the cleaning robot is trapped by a carpet after completing a cleaning operation along a wall. The above situation will be described hereinafter with reference to FIGS. 25 to 30.

Figure 25:
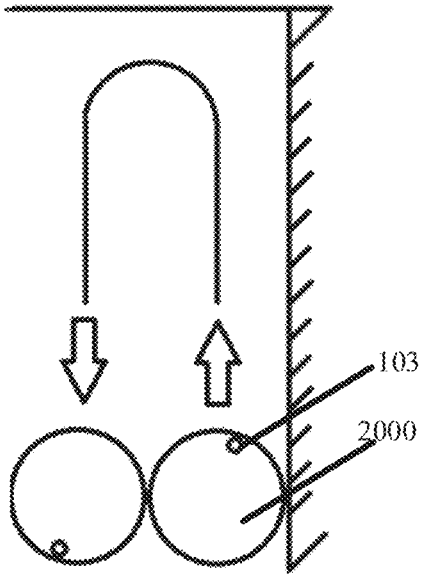
FIG. 25 illustrates a route diagram when a cleaning robot performs cleaning along a wall according to an embodiment of the present disclosure.

As illustrated in FIG. 25, when the cleaning robot 2000 sweeps a floor without carpet along the wall, or a floor corner far away from the carpet, the cleaning robot 2000 may sense a distance between the robot body and the wall through a side distance sensor, keep the distance between the robot body and the wall to be constant, move forwards along the wall edge, and sweep the dust at the wall edge into a cleaning area of a main brush of the robot body through a front side brush 157 of the cleaning robot 2000. The wet cleaning module 400 may be also selected to mop the floor. After the cleaning robot 2000 completes the cleaning operation along the wall, it may autonomously change the travelling direction so as to continue cleaning the floor, as illustrated in FIG. 25.

Figure 26:
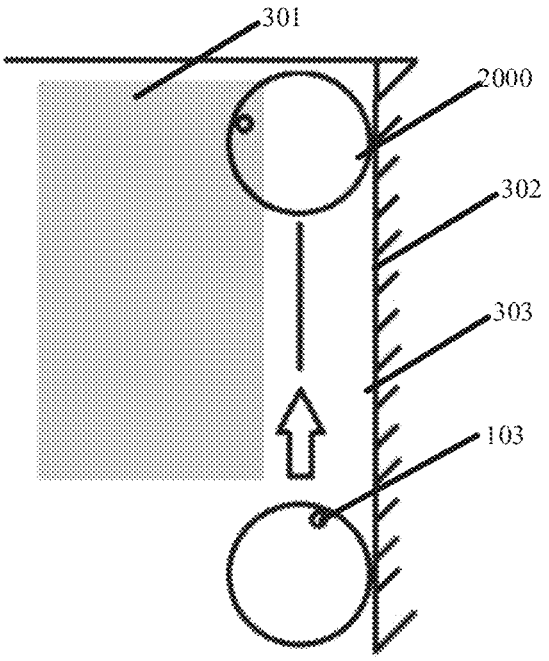
FIG. 26 illustrates a schematic structural view of a cleaning robot when stuck during cleaning along a wall according to an embodiment of the present disclosure.

However, the cleaning robot 2000 may detect the carpet 301 upon changing the travelling direction after completion of cleaning along the wall, that is, a case where a narrow gap 303 exits between the carpet 301 and the wall 302 occurs, as illustrated in FIG. 26. In this case, the surface media sensor 103 is located at a side of the side brush 157 when the cleaning robot 2000 enters the gap 303, that is, the surface media sensor 103 does not detect the carpet 301, and the surface media sensor 103 is not triggered at this time. When the cleaning robot 2000 turns to return after encountering the obstacle or completing cleaning along the wall, the surface media sensor 103 is triggered. If a width of the gap 303 is not enough for the cleaning robot 2000 to turn, the cleaning robot 2000 may get stuck in the gap 30 and cannot escape, causing troubles to the user.

Figure 27:
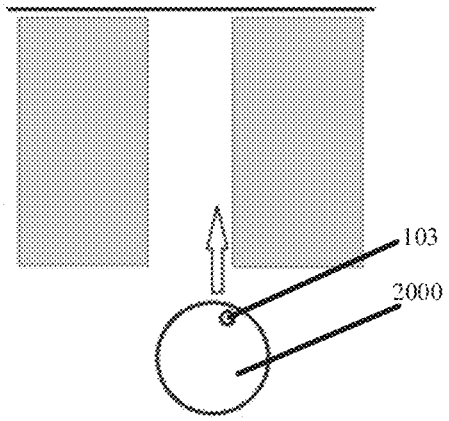
FIG. 27 illustrates a first route schematic diagram when a cleaning robot performs cleaning along an edge of a carpet according to an embodiment of the present disclosure.
Figure 28:
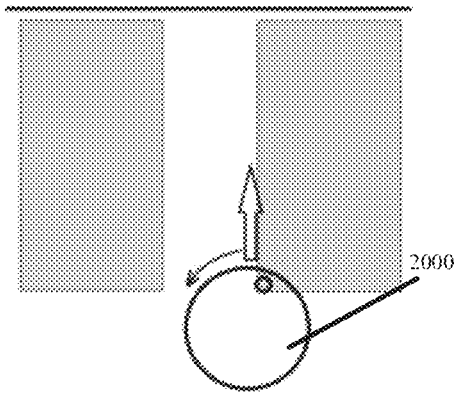
FIG. 28 illustrates a second route schematic diagram when a cleaning robot performs cleaning along an edge of a carpet according to an embodiment of the present disclosure.
Figure 29:
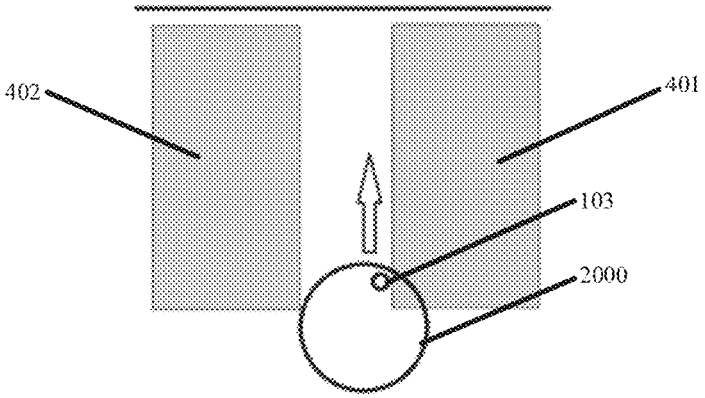
FIG. 29 illustrates a third route schematic diagram when a cleaning robot performs cleaning along an edge of a carpet according to an embodiment of the present disclosure.

In addition, as illustrated in FIG. 27, if the cleaning robot 2000 has detected the carpet before cleaning along a carpet edge, the cleaning robot 2000 controls the robot body to rotate by a certain angle, for example, 15 degrees counter-clockwise as illustrated in FIG. 28. Moreover, the cleaning robot 2000 may advance a short distance in a direction with such angle. After advancing a short distance, the cleaning robot 2000 may turn back to the previous angle, and continue to advance in the direction with the previous angle, while detecting whether the carpet exists. If the carpet is still detected, it is required to continue rotating by a certain angle to repeat the above processes until the carpet is not detected. After that, a mode of sweeping along the carpet edge is enabled, as illustrated in FIG. 29.

In actual applications, the rotation direction and the rotation angle, as well as the short distance of advancement may be set according to actual conditions, which are not limited in embodiments of the present disclosure.

Figure 30:
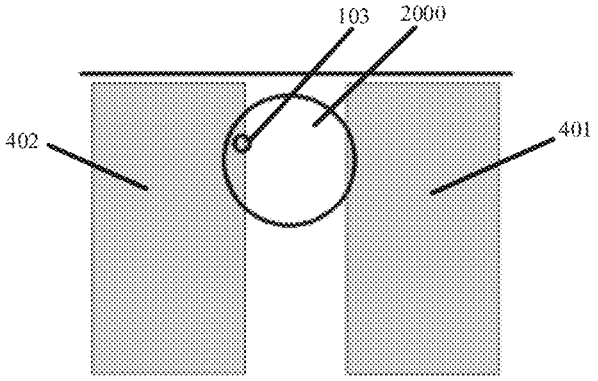
FIG. 30 illustrates a schematic view of a cleaning robot when stuck while cleaning along an edge of a carpet according to an embodiment of the present disclosure.

After the cleaning robot 2000 completes cleaning along the carpet edge, for example, as illustrated in FIG. 30, and after the cleaning robot 2000 finishes cleaning along an edge of a first carpet 401, the cleaning robot 2000 may change directions. However, it is likely to detect another carpet, that is, a second carpet 402 in FIG. 30, during the turning process. If the gap between the first carpet 401 and the second carpet 402 is narrow, and the cleaning robot 2000 enters the gap, the carpet identification device 103 may not detect the second carpet as the carpet identification device 103 is located on one side of the first carpet 401, and the carpet identification device 103 is not triggered at this time. When the cleaning robot 2000 turns to return after completing cleaning along the edge of the first carpet 401, the carpet identification device 103 is triggered. If the width of the gap is not enough for the cleaning robot 2000 to turn, the cleaning robot 2000 may get stuck in the gap and cannot escape, causing troubles to the user.

Figure 31:
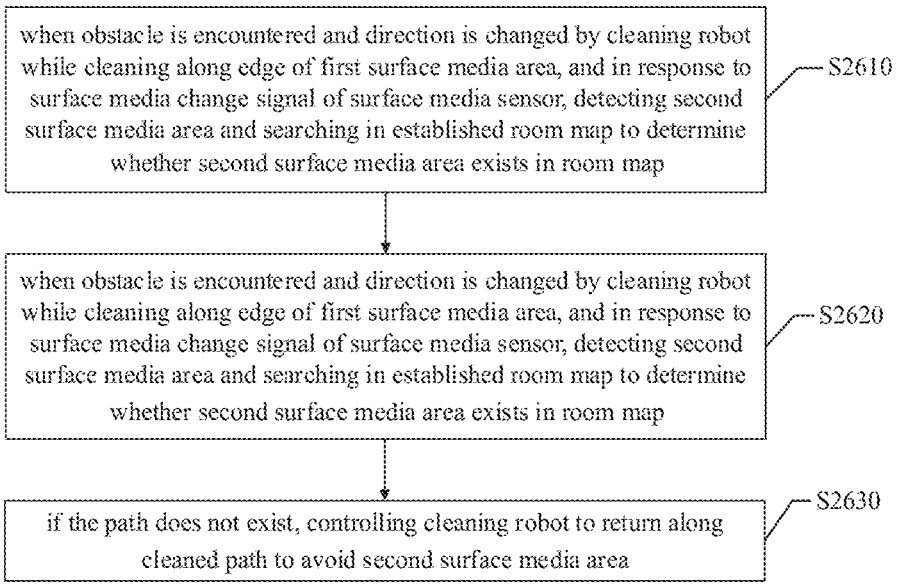
FIG. 31 illustrates a flowchart of a method of a cleaning robot escaping from a trapped state according to an embodiment of the present disclosure.

In view of the above situation, reference can be made to FIG. 31, which illustrates a flowchart of a method of a cleaning robot escaping from a trapped state according to an embodiment of the present disclosure. The method of the cleaning robot escaping from the trapped state includes the following steps.

In step S2610, when an obstacle is encountered and a travelling direction of the cleaning robot is changed while cleaning along an edge of a first surface media area, it is determined that a second surface media area is detected in response to a surface media change signal of the surface media sensor, and it is determined whether the second surface media area exists in a created room map that is created by searching for the second surface media area in the created room map.

In step S2620, in a case that the second surface media area exists in the room map, it is determined whether there is a path bypassing the second surface media area according to the room map and a boundary of the second surface media area in the room map; and in a case that the path exists, the cleaning robot is controlled to travel along the path so as to avoid the second surface media area.

In step S2630, in a case that the path does not exist, the cleaning robot is controlled to return along a cleaned path so as to avoid the second surface media area.

In the method of the cleaning robot escaping from the trapped state according to an embodiment of the present disclosure, when the cleaning robot sweeps along the edge of the first surface media area such as the wall and encounters the obstacle, and then prepares to change its direction to continue cleaning the floor, the surface media sensor is triggered and a change in the surface media signal is detected, so that the second surface media area such as the carpet is identified. At this time, it is determined whether the second surface media area exists in the room map by searching for the second surface media area in a pre-created room map. If the second surface media area exists in the room map, it is determined whether there is a path bypassing the second surface media area according to the room map and the boundary of the second surface media area in the room map, thereby assisting the cleaning robot to escape. In other words, if there is a path along which the second surface media area is bypassed, the cleaning robot is controlled to travel along the path so as to avoid the carpet and get out of the gap between the wall and the carpet. However, if there is no path that can bypass the second surface media area, the cleaning robot is controlled to return along the cleaned path so as to avoid the carpet.

The method of the cleaning robot escaping from the trapped state according to an embodiment of the present disclosure provides a resolution scheme about how to escape when the cleaning robot turns after completing cleaning of the narrow gap area between the carpet and the wall, thereby preventing the cleaning robot from being stuck, improving ability of the cleaning robot to autonomously get out of trouble, reducing failure rate of the cleaning robot, and improving the user experience.

It should be noted that the above-mentioned method of the cleaning robot escaping from the trapped state is applicable to the cleaning robot in a mode in which the carpet is not cleaned or a mode in which the wet cleaning module is enabled. In these two modes, the cleaning robot cannot move on the carpet, that is, a mode in which only the first surface media area is cleaned. Therefore, when the cleaning robot is trapped a the carpet, the cleaning robot may be controlled to escape in a case that the cleaning robot does not move on the carpet through the method of the cleaning robot escaping from the trapped state according to an embodiment of the present disclosure, so as to reduce the probability of the cleaning robot being trapped by the carpet.

In addition, the first surface media herein is at least one of floor surface medias such as a wooden floor, a carpet, a ceramic tile, and a cement surface. The second surface media is different from the first surface media, and is at least one of floor surface medias such as a wooden floor, the carpet, a ceramic tile, and a cement surface.

In an embodiment of the present disclosure, after the cleaning robot has detected the second surface media area when changing moving direction after sweeping along the edge of the first surface media area, it is further required to check whether at least part of the robot body of the cleaning robot has entered the second surface media area by other sensors. If a check result still indicates that at least part of the robot body of the cleaning robot has entered the second surface media area, it is required to control the cleaning robot to travel in an opposite direction, so as to escape from the second surface media area first, thereby avoiding the cleaning robot continuing travelling on the second surface media area, which makes the carpet to be wet or the cleaning robot to be damaged.

Here, by controlling the cleaning robot to travel in the opposite direction, the cleaning robot may be quickly and accurately controlled to escape from the second surface media area, thus preventing the cleaning robot from keeping rotating in the second surface media area and getting trapped.

In practical applications, it is possible to detect whether the cleaning robot has entered the second surface media area according to the actual situation of the cleaning robot. In an embodiment of the present disclosure, it may be detected whether at least part of the cleaning robot has entered the second surface media area by detecting whether the position of the surface media sensor of the cleaning robot is already in the second surface media area. If the position of the surface media sensor is already in the second surface media area, it can be determined that at least part of the cleaning robot has entered the second surface media area. At this time, it is required to control the cleaning robot to escape from the second surface media area through travelling in the opposite direction.

The existing surface media sensor as typically adopted mainly includes an infrared sensor identification device, an ultrasonic sensor identification device, a main brush current detection device, and etc. Various sensor identification devices detect whether a position of the surface media sensor of the cleaning robot is already in the second surface media area through various detecting methods. In an embodiment of the present disclosure, the ultrasonic sensor identification device is taken as an example to describe a solution about how to detect whether the position of the surface media sensor is already in the second surface media area.

Figure 32:
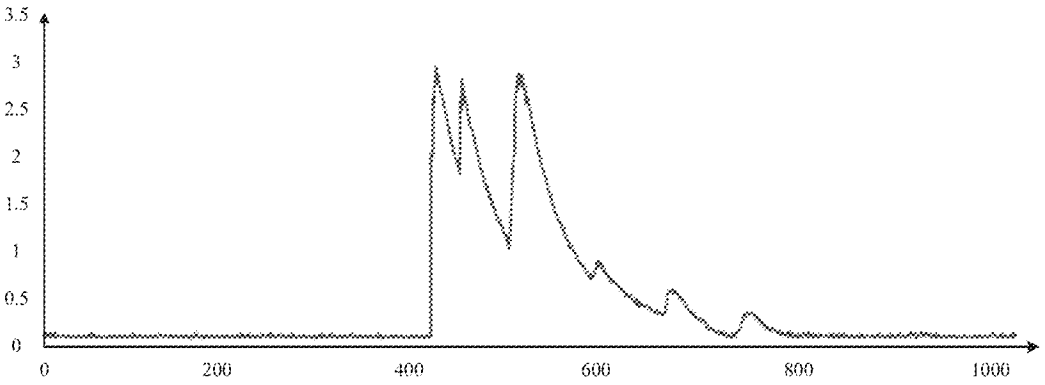
FIG. 32 illustrates a waveform diagram of an echo received by an ultrasonic sensor from a normal floor according to an embodiment of the present disclosure.
Figure 33:
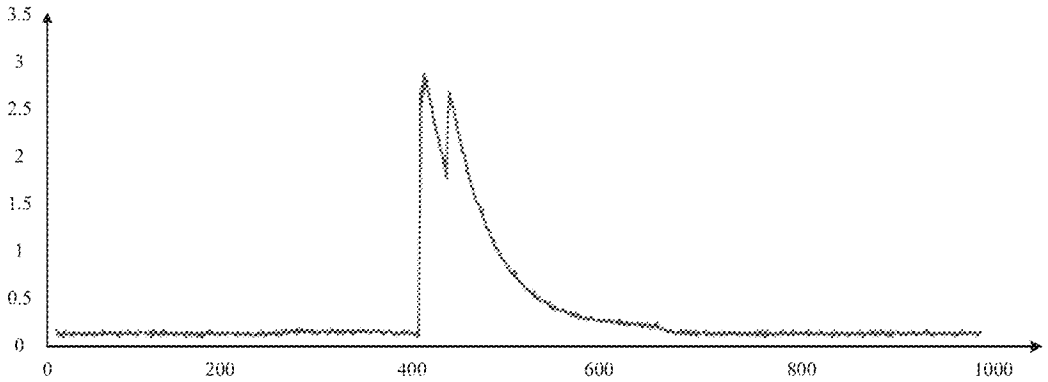
FIG. 33 illustrates a waveform diagram of an echo received by an ultrasonic sensor from a carpet surface according to an embodiment of the present disclosure.

In practical applications, the ultrasonic sensor identification device is configured to transmit an ultrasonic signal to a floor and receive an echo signal reflected by the floor. Because there is a deviation between a waveform of the ultrasonic echo signal from the normal floor and a waveform of the ultrasonic echo signal from the surface of the second surface media area, as illustrated in FIGS. 32 and 33, a surface of the first surface media area and a surface of the second surface media area can be distinguished according to the difference between the echo signals. The surface of the second surface media area refers to a surface of the second surface media area placed on the floor surface. The waveform and the number of peaks of the echo signal may be intended to characterize the signal.

In an embodiment of the present disclosure, detecting whether the position of the surface media sensor of the cleaning robot is already in the second surface media area includes: controlling the surface media sensor to emit an ultrasonic signal perpendicularly to a current surface, and receiving a current echo signal reflected by the current surface; determining whether the current echo signal is different from a first echo signal from a surface of the first surface media area, and in a case that there is a difference, determining that the position of the surface media sensor is already in the second surface media area.

In practical applications, after the ultrasonic sensor receives an electrical signal, it converts the electrical signal into an ultrasonic signal and transmits the ultrasonic signal to the surface of the media area. The ultrasonic signal is reflected by the surface of the media area and is received by the ultrasonic sensor and then converted into an electrical signal. For example, determining the difference between the current echo signal and the echo signal from the surface of the first surface media area may include: determining whether an amount of peaks in the actual echo signal is less than an amount of peaks in the first echo signal from the surface of the first surface media area; and if the amount of peaks in the current echo signal is less than the amount of peaks in the first echo signal from the surface of the first surface media area, identifying the current floor as a surface of the second surface media area. In an embodiment of the present disclosure, for different areas, the current echo signals may be respectively compared with the first echo signal from the surface of the first surface media area corresponding to the current area, so as to improve the accuracy in identifying the second surface media area.

In an embodiment of the present disclosure, the echo signal from the second surface media area is determined based on the first echo signal from the surface of the first surface media area, so that the difficulty in identifying the second surface media area may be reduced, and the accuracy and precision of the cleaning robot to identify the second surface media area is improved.

In an embodiment of the present disclosure, when the cleaning robot is controlled to return along the cleaned path, it is necessary to control the cleaning robot to reverse and try to stay away from the second surface media area as much as possible. If the position of the surface media sensor of the cleaning robot is still in the second surface media area after the cleaning robot reverses, the cleaning robot is controlled to rotate in place, until it is determined that the cleaning robot has escaped from the second surface media area. After that, the cleaning robot may continue to rotate in place, so as to make the travelling direction of the cleaning robot in parallel with the edge of the first surface media area, and control the cleaning robot to return according to the travelling direction.

If the cleaning robot leaves the second surface media area after the cleaning robot reverses (though it may encounter an obstacle during the reversing process and cannot complete reversing), the cleaning robot is directly controlled to rotate in place, so as to make the travelling direction of the cleaning robot in parallel with the edge of the first surface media area, and control the cleaning robot to return according to the travelling direction.

During the returning process, the cleaning robot may be controlled to adopt a forward return mode or a reverse return mode. In the forward return mode, the cleaning robot is controlled to turn around based on the cleaned path and travel along the cleaned path. In the reverse return mode, the cleaning robot is controlled to reverse based on the cleaned path. In an exemplary embodiment of the present disclosure, in order to prevent the cleaning robot from continuing making false determinations and alarming, the reverse return mode is adopted to ensure that the cleaning robot quickly returns to an initial position. The initial position here may indicate a position where the cleaning robot starts cleaning along the wall, which is not limited by embodiments of the present disclosure.

Determining whether the cleaning robot has escaped from the second surface media area is similar to determining whether the position of the surface media sensor of the cleaning robot is already in the second surface media area. When the current echo signal is similar to the first echo signal from the surface of the first surface media area, it is determined that the cleaning robot has escaped from the second surface media area, which will be not elaborated here.

In an embodiment of the present disclosure, in case that it is determined that the second surface media area does not exist in the room map, a mode of following an edge of the second surface media area is enabled, so as to scan the edge of the second surface media area, and store a scan result in the room map for use next time.

According to the room map recorded by the cleaning robot, it is determined whether the cleaned path of the cleaning robot is a path along the wall through detection after the cleaning robot has detected the second surface media area after the direction change. In a case that the cleaned path of the cleaning robot is a path along the wall, the cleaning robot is controlled to return according to the path along the wall.

In an exemplary embodiment of the present disclosure, it is determined whether the second surface media area exists behind the cleaning robot based on the room map. In a case that the second surface media area exists behind the cleaning robot, the cleaning robot is controlled to return according to the cleaned path.

In an exemplary embodiment of the present disclosure, controlling the cleaning robot to return according to the path along the wall or the cleaned path includes: controlling the cleaning robot to retreat according to the path along the wall or the cleaned path; and rotating the cleaning robot in place after a retreat distance reaches a preset distance, so that the cleaning robot leaves the second surface media area as soon as possible and gets out of trouble.

In practical applications, when the retreat distance reaches a preset distance, the cleaning robot is controlled to rotate in place. During the rotation of the cleaning robot in place, if the second surface media area is detected in response to the surface media change signal of the surface media sensor, it means that the cleaning robot has not left the second surface media area, that is, has not gotten out of the trap. In this case, the cleaning robot is controlled to continue to retreat, until the surface media sensor detects no surface media change signal, and then it is determined that the cleaning robot is out of trap.

In an exemplary embodiment of the present disclosure, the preset retreat distance may be at least one-half of a length of the robot body. Typically, after retreating one-half of the length of the robot body, it can be ensured that the cleaning robot avoids the previous detection scope during the rotation. In practical applications, the preset distance may also be other distances greater than one-half of the length of the robot body, which is not limited in the present disclosure.

In practical applications, an in-situ rotation angle of the cleaning robot may be between 15-90 degrees, and the in-situ rotation angle may also be increased in a progressive mode. That is, if the cleaning robot rotates in-situ by 15 degrees, the second surface media area fails to be detected, and then the cleaning robot is controlled to rotate by another 15 degrees or other angles greater than 15 degrees. When the surface media change signal is still not detected after a rotation up to 90 degrees, it is determined that the cleaning robot has avoided the second surface media area.

In practical applications, there are usually cases where the second surface media area does not exist in the room map. For example, the cleaning robot enters a new room, or the cleaning robot has not create the room map. At this time, it is difficult for the cleaning robot to determine a path bypassing the second surface media area in advance. In this case, the method of the cleaning robot escaping from the trapped state according to an embodiment of the present disclosure helps the robot to escape by ignoring the surface media change signal of the surface media sensor and continuing to control the cleaning robot to turn and return along the cleaned path.

In an embodiment of the present disclosure, when the cleaning robot turns and the second surface media area is detected, the cleaning robot may be assisted to get out of trouble by directly determining whether there is a path bypassing the second surface media area. A method of determining a path bypassing the second surface media area may include searching in a created room map to determine whether the second surface media area exists in the room map. If the second surface media area exists in the room map, it is determined whether there is a path bypassing the second surface media area according to the room map and a boundary of the second surface media area in the room map, thereby helping the cleaning robot get out of trouble. That is, if there is a path bypassing the second surface media area, the cleaning robot is controlled to travel along the path to avoid the second surface media area, so that the cleaning robot enters a normal cleaning mode.

However, if the second surface media area does not exist in the above room map, a boundary scan mode of the cleaning robot is activated to scan an edge of the second surface media area, and edge information of the second surface media area obtained by scanning is stored in the room map to provide a reference for next cleaning operation.

In an exemplary embodiment of the present disclosure, during the process of controlling the cleaning robot to turn and return along the cleaned path, the surface media change signal of the surface media sensor may be continuously detected to determine whether the surface media change signal of the surface media sensor disappears. If the surface media change signal of the surface media sensor disappears, and the surface media sensor no longer sends the surface media change signal, it indicates that the cleaning robot has escaped from the second surface media area. In this case, the cleaning robot may be controlled to continue advancing a preset distance. After the preset distance has been advanced, the cleaning robot is controlled to stop and rotate in place by one revolution, so as to determine whether the cleaning robot has escaped from the second surface media area.

In an exemplary embodiment of the present disclosure, if the surface media sensor of the cleaning robot triggers the surface media change signal during one revolution of the cleaning robot, it means that the cleaning robot has encountered a new surface media area, or the cleaning robot has not completely escaped from the second surface media area. In this case, the cleaning robot may be controlled to continue returning along the cleaned path, so as to get out of trouble.

However, if the surface media sensor of the cleaning robot does not trigger the surface media change signal during one revolution of the cleaning robot, it means that the cleaning robot has escaped from the second surface media area, and there is no new surface media area obstructing it. In this case, the cleaning robot may be controlled to enter the normal cleaning mode to continue cleaning the first surface media area.

In practical applications, the cleaning robot further includes other functions that help to realize the overall operation, which is not elaborated in the exemplary embodiments of the present disclosure.

It should be noted that the above method is not only applicable to the cleaning robot with the dry cleaning module and the wet cleaning module, but also applicable to the sweeping robot with only the dry cleaning module or the mopping robot with only the wet cleaning module. It may be further applicable to other intelligent robots that have an autonomous travelling mechanism and is required to identify the shape of the floor, which is not limited in embodiments of the present disclosure.

It should be noted that, although various steps of the method in the present disclosure are described in a specific order depicted in the accompanying drawings, this is not required or implied that the steps must be performed in this specific order, or a desired result may be realized by performing all the steps illustrated. Additionally or alternatively, certain steps may be omitted, a plurality of steps may be combined into one step to execute, and/or one step may be decomposed into a plurality of steps to execute, and the like.

Figure 34:
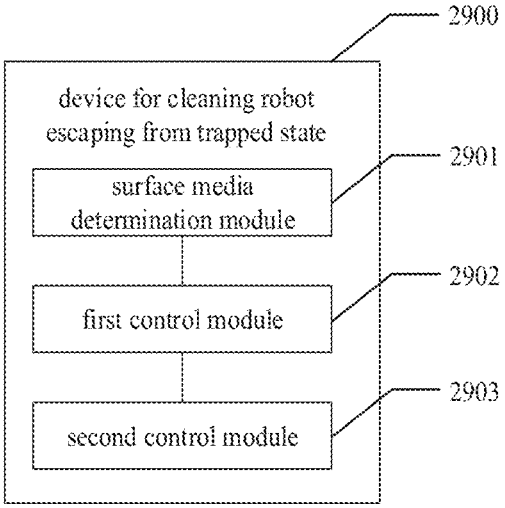
FIG. 34 illustrates a block diagram of a device for a cleaning robot escaping from a trapped state according to an embodiment of the present disclosure.

In an embodiment of the present disclosure, there is further provided a device for a cleaning robot escaping from a trapped state, which is applicable to a cleaning robot including a surface media sensor. As illustrated in FIG. 34, the device 2900 for the cleaning robot escaping from the trapped state may include: a surface media determination module 2901, a first control module 2902, and a second control module 2903.

The surface media determination module 2901 is configured to, detect a second surface media area in response to a surface media change signal of the surface media sensor when an obstacle is encountered and a travelling direction is changed by the cleaning robot while the cleaning robot cleans along an edge of a first surface media area, and, and search for the second surface media area in a created room map to determine whether the second surface media area exists in the room map.

The first control module 2902 is configured to, in response to determine that the second surface media area exists in the room map, determine whether there is a path bypassing the second surface media area according to the room map and a boundary of the second surface media area in the room map, and in a case that the path exists, control the cleaning robot to travel along the path to avoid the second surface media area.

The second control module 2903 is configured to, in a case that the path does not exist, control the cleaning robot to return along a cleaned path to avoid the second surface media area.

The details of each module in the above-mentioned device for the cleaning robot escaping from the trapped state have been described in the respective method for the cleaning robot escaping from the trapped state, so it will not be elaborated here.

It should be noted that, although several modules or units of device for action execution are mentioned in the detailed description above, such division is not mandatory. Indeed, according to embodiments of the present disclosure, the features and functions of two or more modules or units described above may be embodied in one module or unit. Conversely, the features and functions of one of the modules or units described above may be further divided into a plurality of modules or units to embody.

In an exemplary embodiment of the present disclosure, there is provided an electronic apparatus capable of implementing the above method.

Those skilled in the art may understand that various aspects of the present invention may be implemented as a system, method, or program product. Therefore, various aspects of the present invention may be embodied in the following forms: a complete hardware implementation, a complete software implementation (including firmware, microcode, etc.), or a combination implementation of hardware and software, which may be collectively referred to as 'circuit', 'module', or 'system' herein.

The electronic apparatus 3000 according to an embodiment of the present invention is described below with reference to FIG. 35. The electronic apparatus 3000 illustrated in FIG. 35 is merely an example, and should not impose any limitation on the functions and scope of use of embodiment of the present invention.

Figure 35:
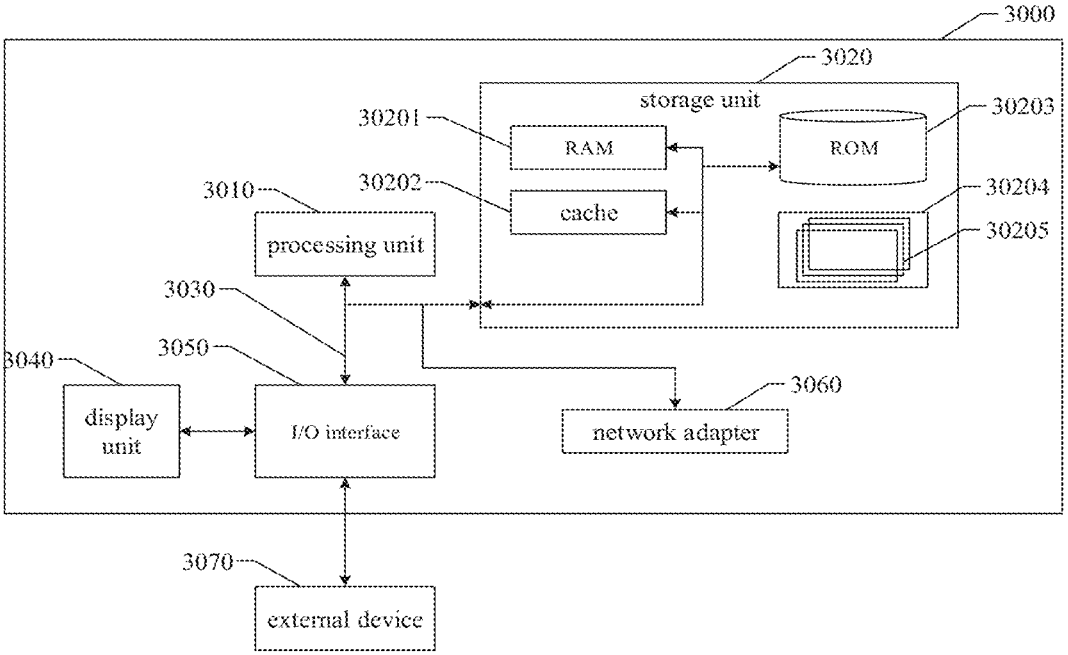
FIG. 35 illustrates a schematic modular diagram of an electronic apparatus according to an embodiment of the present disclosure.

As illustrated in FIG. 35, the electronic apparatus 3000 is expressed in the form of a general-purpose computing device. Components of the electronic apparatus 3000 may include, but are not limited to, at least one processing unit 3010, at least one storage unit 3020, a bus 3030 connecting different system components (including the storage unit 3020 and the processing unit 3010), and a display unit 3040.

In the example above, the storage unit 3020 stores program codes, and the program codes may be executed by the processing unit 3010, so that the processing unit 3010 executes various steps of the exemplary embodiments according to the present invention described in the above-mentioned section of the specification. For example, the processing unit 3010 may perform the steps in FIG. 31. In the step S2610, a second surface media area is detected in response to a surface media change signal of a surface media sensor when an obstacle is encountered and a traveling direction is changed by the cleaning robot while the cleaning robot cleans along an edge of a first surface media area and the second surface media area is searched for in a created room map, so as to determine whether the second surface media area exists in the room map. In the step S2620, in a case that the second surface media area exists in the room map, it is determined whether there is a path bypassing the second surface media area according to the room map and a boundary of the second surface media area in the room map; and in a case that the path exists, the cleaning robot is controlled to travel along the path to avoid the second surface media area. In the step S2630, in a case that the path does not exist, the cleaning robot is controlled to turn and return along a cleaned path to avoid the second surface media area.

The storage unit 3020 may include a readable medium in the form of a volatile storage unit, such as a random access storage unit (RAM) 30201 and/or a cache storage unit 30202. It may further include a read-only storage unit (ROM) 30203.

The storage unit 3020 may further include a program or utility tool 30204 having a set of (at least one) program modules 30205. Such program modules 30205 include, but are not limited to, an operating system, one or more application programs, other program modules, and program data. Each or some combination of these examples may include an implementation of a network environment.

The bus 3030 indicates one or more bus structures of various types, and includes a storage unit bus or a bus structure applicable to a storage unit controller, a peripheral bus, a graphics acceleration port, a processing unit, or a local bus that uses various bus structures.

The electronic apparatus 3000 may further communicate with one or more peripheral devices 3070 (such as a keyboard, pointing device, Bluetooth device, etc.). It may further communicate with one or more devices that enable a user to interact with the electronic apparatus 3000, and/or communicate with any device (e.g., router, modem, etc.) that enables the electronic apparatus 3000 to communicate with one or more other computing devices. Such communication may be performed through an input/output (I/O) interface 3050. Moreover, the electronic apparatus 3000 may further communicate with one or more networks (such as a local area network (LAN), a wide area network (WAN), and/or a public network, such as the Internet) through the network adapter 3060. As illustrated, the network adapter 3060 communicates with other modules of the electronic apparatus 3000 through the bus 3030. It should be understood that although not illustrated in the figures, other hardware and/or software modules may be used in conjunction with the electronic apparatus 3000, comprising, but not limited to, microcode, device drivers, redundant processing units, external disk drive arrays, RAID systems, tape drives, data backup storage systems, and the like.

Through the description of the above embodiments, those skilled in the art will readily understand that the exemplary embodiments described here may be implemented by software or by software in combination with necessary hardware. Therefore, the technical solution according to embodiments of the present disclosure may be embodied in a form of software product, which may be stored in a non-volatile storage medium (which may be a CD-ROM, a USB disk, a mobile hard disk, etc.) or on a network, including a number of instructions to enable a computing device (which may be a personal computer, a server, a terminal device, or a network device, etc.) to perform the methods according to embodiments in the present disclosure.

In an exemplary embodiment of the present disclosure, there is also provided a computer-readable storage medium on which a program product capable of implementing the above-mentioned method of the present disclosure is stored. In some possible implementation modes, aspects of the present disclosure may also be implemented in the form of a program product, which includes program code. When the program product runs on a terminal device, the program code is used to cause the terminal device to perform the steps according to various exemplary embodiments of the present invention described in the above-mentioned section of the present specification.

Figure 36:
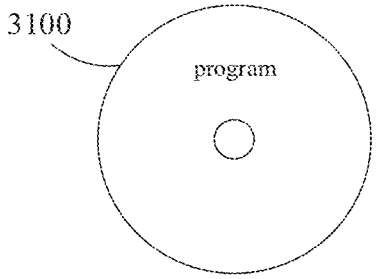
FIG. 36 illustrates a schematic diagram of a program product according to an embodiment of the present disclosure.

Referring to FIG. 36, a program product 3100 for implementing the above method according to an embodiment of the present invention is described. The program product 3100 can use a portable compact disc read-only memory (CD-ROM) and include the program code, which may run on a terminal device, for example, personal computer. However, the program product of the present disclosure is not limited thereto. In the present description, the readable storage medium may be any tangible medium containing or storing program, and the program may be used by or in combination with an instruction execution system, apparatus, or device.

The program product may employ any combination of one or more readable media. The readable medium may be a readable signal medium or a readable storage medium. The readable storage medium may be, for example, but is not limited to, an electronic, magnetic, optical, electromagnetic, infrared, or semiconductor system, apparatus, or device, or any combination thereof. More specific examples (non-exhaustive list) of the readable storage media include: electrical connection with one or more wires, portable disk, hard disk, random access memory (RAM), read-only memory (ROM), erasable programmable read-only memory (EPROM or flash memory), optical fiber, portable compact disc read-only memory (CD-ROM), optical storage device, magnetic storage device, or any suitable combination of the foregoing.

The computer-readable signal medium may include a data signal in baseband or propagated as a part of a carrier wave, which carries readable program code. Such a propagated data signal may take many forms, comprising but not limited to electromagnetic signals, optical signals, or any suitable combination of the foregoing. The readable signal medium may also be any readable medium other than a readable storage medium. The readable medium may send, propagate, or transmit a program for use by or in combination with an instruction execution system, apparatus, or device.

The program code contained on the readable medium may be transmitted using any appropriate medium, comprising but not limited to wireless, wired, optical cable, RF, etc., or any suitable combination of the foregoing.

The program code for performing the operations of the present disclosure may be written in any combination of one or more programming languages, which include object-oriented programming languages, such as Java, C++, etc. and further include conventional procedural programming language, such as 'C' or a similar programming language. The program code may be executed entirely or partly on the user computing device, may be executed as an independent software package, may be executed partly on the user computing device and partly on the remote computing device, or may be executed entirely on the remote computing device or server. In case that remote computing devices are involved, the remote computing devices may be connected to the user computing device via any kind of network, such as a local area network (LAN) or a wide area network (WAN). Alternatively, it may be connected to external computing devices, for example, connected to external computing devices, via the Internet by use of an Internet service provider.

In addition, the above-mentioned drawings are merely a schematic description of process included in the method of an exemplary embodiment of the present disclosure, and are not intended to be limiting. It is easy to understand that the processes illustrated in the above drawings does not indicate or limit the chronological order of these processes. In addition, it is also easy to understand that these processes may be performed synchronously or asynchronously in a plurality of modules, for example.

Finally, it should be noted that various embodiments in the present specification are described in a progressive mode, and each embodiment focuses on its differences from other embodiments, and for the same or similar parts between the various embodiments, the previous embodiments may be referred to. For the system or device disclosed in embodiments of the present disclosure, corresponding to the method disclosed in embodiments of the present disclosure, the description is relatively simple, and the description of the method part may be referred to.

The above embodiments are only used to illustrate the technical solutions of the present disclosure, but not intended to limit them. Although the present disclosure has been described in detail with reference to the foregoing embodiments, those ordinary skilled in the art should understand that the technical solutions recorded in the foregoing embodiments may be stilled modified, and some of the technical features may be equivalently replaced. These modifications or replacements do not cause the essence of the corresponding technical solutions to deviate from the spirit and scope of the technical solutions of embodiments of the present disclosure.

What is claimed is:

1. An autonomous cleaning device, comprising:

a mobile platform, configured to move autonomously on a cleaning surface; and a cleaning module, disposed on the mobile platform and comprising:

a wet cleaning module, configured to clean at least part of the cleaning surface in a wet cleaning mode;

wherein the wet cleaning module comprises: a cleaning head, configured to clean the cleaning surface; and a driving unit, configured to drive the cleaning head to conduct a reciprocating movement on a target surface, the target surface being a part of the cleaning surface; and wherein the driving unit comprises: a support platform, configured to support the cleaning head; and a cleaning base plate, disposed freely movable on the support platform, the cleaning base plate being configured to conduct a substantially reciprocating movement with respect to the support platform; and wherein the cleaning head comprises a movable section and a fixed section located at different positions in a horizontal extension plane of the cleaning head, the movable section being connected to the cleaning base plate, and the fixed section being connected to the support platform.

2. The autonomous cleaning device according to claim 1, wherein the driving unit further comprises:

a driving platform, connected to a bottom surface of the mobile platform and configured to provide a driving force; and the support platform, connected to the driving platform.

3. The autonomous cleaning device according to claim 2, wherein the driving unit further comprises:

a driving wheel, configured to perform a swing motion under driving of a motor, thereby driving the cleaning base plate to conduct the substantially reciprocating movement.

4. The autonomous cleaning device according to claim 3, wherein the driving wheel is connected to the cleaning base plate through a pivot disposed on the driving wheel, the cleaning base plate is configured to conduct the reciprocating movement under driving of the pivot on the driving wheel, and a pivotal center of the pivot does not coincide with a swing center of the driving wheel.

5. The autonomous cleaning device according to claim 4, wherein the cleaning base plate has a first end and a second end;

the first end of the cleaning base plate is provided with a slider configured to be slidable along a sliding groove in the support platform; and the second end of the cleaning base plate is configured to conduct a circular reciprocating movement along with the pivot, so that the reciprocating movement of the cleaning base plate is achieved.

6. The autonomous cleaning device according to claim 4, wherein there are two driving wheels connected with two ends of the cleaning base plate respectively through pivots disposed thereon; and the two ends of the cleaning base plate are configured to conduct circular reciprocating movements along with the pivots, so that the reciprocating movement of the cleaning base plate is achieved.

7. The autonomous cleaning device according to claim 3, wherein the driving platform further comprises a vibration member having a first end and a second end;

the first end of the vibration member is connected with the cleaning base plate;

the second end of the vibration member is connected with the driving wheel; and the vibration member is configured to drive the cleaning base plate to conduct the substantially reciprocating movement under driving of the driving wheel.

8. The autonomous cleaning device according to claim 7, wherein the driving wheel is connected to an output shaft of the motor and has an asymmetrical structure; and the vibration member is connected to the driving wheel and conducts a reciprocating movement under an asymmetrical rotation of the driving wheel.

9. The autonomous cleaning device according to claim 8, wherein the driving platform further comprises:

a connection rod, configured to connect the driving wheel with the vibration member.

10. The autonomous cleaning device according to claim 7, wherein the driving platform further comprises:

a connection rod, configured to connect the driving wheel with the vibration member.

11. The autonomous cleaning device according to claim 10, wherein the cleaning base plate comprises:

an assembly notch, disposed at a position in contact with the vibration member, wherein the vibration member is fitted in the assembly notch when the support platform is connected onto the driving platform.

12. The autonomous cleaning device according to claim 10, wherein the driving platform further comprises: a vibration buffer device, disposed on the connection rod and configured to reduce vibration in a certain direction.

13. The autonomous cleaning device according to claim 2, wherein the support platform is detachably connected to the driving platform; and the support platform further comprises: a detachment button, disposed on at least one side of the support platform and configured to be detachably connected to the driving platform.

14. The autonomous cleaning device according to claim 1, wherein the support platform further comprises:

at least one fitting section, disposed on the support platform and configured to fit the cleaning head.

15. The autonomous cleaning device according to claim 1, wherein the movable section is configured to conduct a substantially reciprocating movement along the target surface under driving of the cleaning base plate.

16. The autonomous cleaning device according to claim 15, wherein the movable section is provided with an adhesive layer on a side of the movable section connected to the cleaning base plate, and the movable section is connected with the cleaning base plate through the adhesive layer.

17. The autonomous cleaning device according to claim 15, wherein the fixed section is configured to clean at least part of the cleaning surface with movement of the support platform.

18. The autonomous cleaning device according to claim 17, wherein the cleaning head further comprises:

a flexible connection part, disposed between the fixed section and the movable section and configured to connect the fixed section with the movable section.

19. The autonomous cleaning device according to claim 18, wherein the cleaning head further comprises:

a sliding buckle, extending along an edge of the cleaning head and detachably mounted on the support platform.

* * * * *